US006299730B1

(12) United States Patent
Broek et al.

(10) Patent No.: US 6,299,730 B1
(45) Date of Patent: Oct. 9, 2001

(54) METHOD AND SYSTEM FOR MONITORING WEB DEFECTS ALONG A MOVING PAPER WEB

(75) Inventors: David Broek, Westerville; Dirk Everett Swinehart, Chillicothe, both of OH (US); Kevin Paul Connolly, Escanaba, MI (US)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/399,594

(22) Filed: Sep. 20, 1999

(51) Int. Cl.[7] ..... D21F 11/00

(52) U.S. Cl. ..... 162/198; 162/263; 162/DIG. 10; 162/DIG. 11; 356/431; 356/430; 356/429; 702/127

(58) Field of Search ..... 162/198, 263, 162/DIG. 10, DIG. 11; 356/431, 430, 429; 702/127

(56) References Cited

U.S. PATENT DOCUMENTS

| | | |
|---|---|---|
| 3,627,944 | 12/1971 | Field . |
| 4,728,800 | 3/1988 | Surka . |
| 4,979,029 | 12/1990 | Lemelson . |
| 5,389,789 | 2/1995 | Nguyen . |
| 5,654,799 | 8/1997 | Chase et al. . |
| 5,745,365 | 4/1998 | Parker . |
| 5,821,990 | 10/1998 | Rudt et al. . |
| 5,854,683 | 12/1998 | Keane . |

FOREIGN PATENT DOCUMENTS 56043156 4/1981 (JP) .

OTHER PUBLICATIONS

Swinehart et al., "Tenacity and Fracture Toughness of Paper and Board", *Journal of Pulp and Paper Science*, vol. 21, No. 11, pp. J389–J397 (11/95).

Swinehart et al., "Tenacity, fracture mechanics, and unknown coater web breaks", *Tappi Journal*, vol. 79, No. 2, pp. 233–237 (2/96).

Kortschot et al., "Predicting the strength of paper containing holes or cracks with the point stress criterion", *Tappi Journal*, vol. 81, No. 1, pp. 254–259 (1/98).

International Search Report issued in corresponding International Application No. PCT/US 00/40947 mailed Apr. 27, 2001.

*Primary Examiner*—Stanley S. Silverman
*Assistant Examiner*—Mark Halpern
(74) *Attorney, Agent, or Firm*—Thompson Hine & Flory LLP

(57) ABSTRACT

A method and system for monitoring web defects along a moving web of paper involves determining a dimension of a web defect as the paper web moves along an established paper path in a machine direction. A distance from a side edge of the paper web to a location of the web defect is also determined as the paper web moves along the established paper path. A value indicative of a likelihood of paper web failure at the web defect is then established based at least in part upon both the determined dimension and the determined distance. A determination of whether to stop the moving paper web for repair of the web defect can then be made based at least in part upon the determined failure likelihood indicative value. An alternative technique involves establishing a plurality of paper web width regions. A dimension of a web defect is determined as the paper web moves along an established paper path in a machine direction. The web defect is categorized as falling into one of the established paper web width regions. A determination of whether to repair the web defect can then be made based at least in part upon the determined dimension and the categorization made.

34 Claims, 19 Drawing Sheets

STRENGTH FOR 10-INCH WIDE SPECIMENS AS A FUNCTION OF EDGE DISTANCE

Holes; uncracked only; Prediction vs. Test

Holes; cracked only; Prediction vs. Test

Irregular defects; Prediction vs. Test

METHOD AND SYSTEM FOR MONITORING WEB DEFECTS ALONG A MOVING PAPER WEB

TECHNICAL FIELD

The present invention relates generally to paper making machinery and, more particularly, to a method for monitoring web defects which involves scanning the moving paper web and utilizing both a detected defect size parameter and a detected distance from the paper web edge to establish a likelihood of web failure.

BACKGROUND

Productivity and profitability of paper making is determined by the speed of production, that is, the speed with which the paper web progresses through the paper making and paper processing equipment. Production speeds may be as high as 4000 ft/min, but 5000 ft/min or higher would obviously be more profitable. So-called web breaks seriously limit production for two reasons. First, a web break stops production for up to 45 minutes causing a loss of 45×4000=180,000 ft of production (up to 6 tons of paper). Up to 6 web breaks may occur in 24 hours. Second, the higher the production speed, the more web breaks occur, so that production speed is limited by the number of web breaks.

Paper is produced as a continuous sheet of a width often greater than 20 feet. This continuous sheet is commonly referred to as the 'web'. At the end of the machine the paper is wound on a roll. When a roll has reached a certain size, the web is cut on-the-fly, and a new roll is wound automatically. The rolls so produced are called 'logs'. In line with the paper machine is the re-reeler in which the logs are rewound. The purpose of the re-reeler will be explained in the following. The logs coming from the re-reeler are fed into the coater, a machine several hundred feet in length in line with paper machine and re-reeler. In the coater the paper is coated, often on both sides, usually with a clay-based material, primarily to improve printability. The initial web coating must be dried, the other side coated and dried and the final product wound up in new logs. Web breaks in the coater are of concern here. If the web breaks paper is spewed all over at 4000 ft/min. The machine has to be stopped and rewound with the associated production loss as explained above. These web breaks are caused by defects in the paper introduced in the paper machine. Control in the production process in the paper machine must detect those defects. In the re-reeler these defects are repaired if serious enough. But repairs are costly and time consuming. In one aspect of the invention proposed here will automatically identify those defects that warrant repair, mark them and make the re-reeler stop automatically at the defect so that a repair can be made and, more important, automatically decide which defects should be repaired, and which should not, depending upon the chance the defect would cause a web break. This allows optimization of production. Alternatively, another aspect of the invention enables those defects that most warrant repair to be marked, such as by automatically marking the paper web in the region of the defect, so that a machine operator can stop movement of the paper web at the re-reeler and repair the marked defect if desired.

As used herein, the terminology "through web defect" refers to any defect which passes completely through the thickness of the paper web such as cracks, circular holes, elliptical holes, and irregular holes. The terminology "web defect" refers to both through web defects and other types of defects including, but not limited to light spots and dark spots caused by significant variances in thickness of the paper web and/or clumps of material. As pointed out in applicant's paper entitled Tenacity, Fracture Mechanics and Unknown Coater Web Breaks TAPPI J. 79(2) Kovalin 233 (1996), such through web defects reduce the strength of the paper web in the region of the defects permitting failure or breaking of the paper web in the region of such defects at a lower tension. The advantage of using fracture mechanics to determine the failure strength of through web defects is likewise described in the subject paper.

Accordingly, a system for real time monitoring of web defects combined with a method to evaluate which defects should be repaired, will be of great benefit.

SUMMARY OF THE INVENTION

In one embodiment, a method for monitoring web defects along a moving web of paper involves determining a dimension of a web defect as the paper web moves along an established paper path in the machine direction. A distance from a side edge of the paper web to a location of the web defect is also determined as the paper web moves along the established paper path. A value indicative of a likelihood of paper web failure at the web defect is then established based at least in part upon both the determined dimension and the determined distance. A determination of whether to repair of the web defect at a subsequent operation, such as a re-reeler, can then be made based at least in part upon the determined failure likelihood indicative value.

Because the most critical dimension of any web defect is the cross machine direction size, it is preferred that such cross machine direction size is determined and used in the subject method. Further, the subject distance used in the method should preferably be the distance from the cross machine direction center of the web defect to the side edge of the paper web in the cross machine direction. However, the distance from the edge of the web defect to the side edge of the paper web could also be used in the subject method. Fracture mechanics is used to establish the relative failure strength (a failure likelihood indicative value), i.e., relative to that of a flawless web under otherwise the same conditions. Depending upon the acceptable relative failure strength—economically acceptable on the basis of anticipated breaks—a decision can then be made whether or not to repair the defect. It should be emphasized that fracture mechanics itself is a general science used in all areas of technology, although it is not accepted as such in paper making technology. In this application the general fracture mechanics equations have been modified on the basis of extensive testing by applicant, to apply specifically to the technology of paper making and coating. This relative failure strength can then be compared to a threshold failure value to determine whether to repair the defect. In this regard, an operator alert is generated so that the operator can consider whether or not the subject web defect should be repaired. By repairing those defects which have the greatest likelihood of causing a paper web break, the productivity of a particular coater can be substantially increased.

In another embodiment, a method for monitoring web defects along a moving web of paper involves establishing a plurality of paper web width regions for the paper web being monitored. A dimension of a web defect is determined as the paper web moves along an established paper path in a machine direction and the web defect is categorized as falling into one of the established paper web width regions. A determination of whether to repair the web defect is then made based at least in part upon the determined dimension and the categorization made.

A system for implementing the subject method includes an optical scanning device having a plurality of CCD cameras arranged to view the entire width of the paper web as the paper web moves along the established paper path. The scanning device produces paper web image signals which are transmitted to a controller which is configured and programmed to analyze web defects utilizing the location of the web defect relative to the side edge of the paper web as a variable. Applicant has conducted a number of tests which show that edge distance is an important variable which, when taken into account, enables improved selection of web defects for repair.

DETAILED DESCRIPTION

Figure 1:
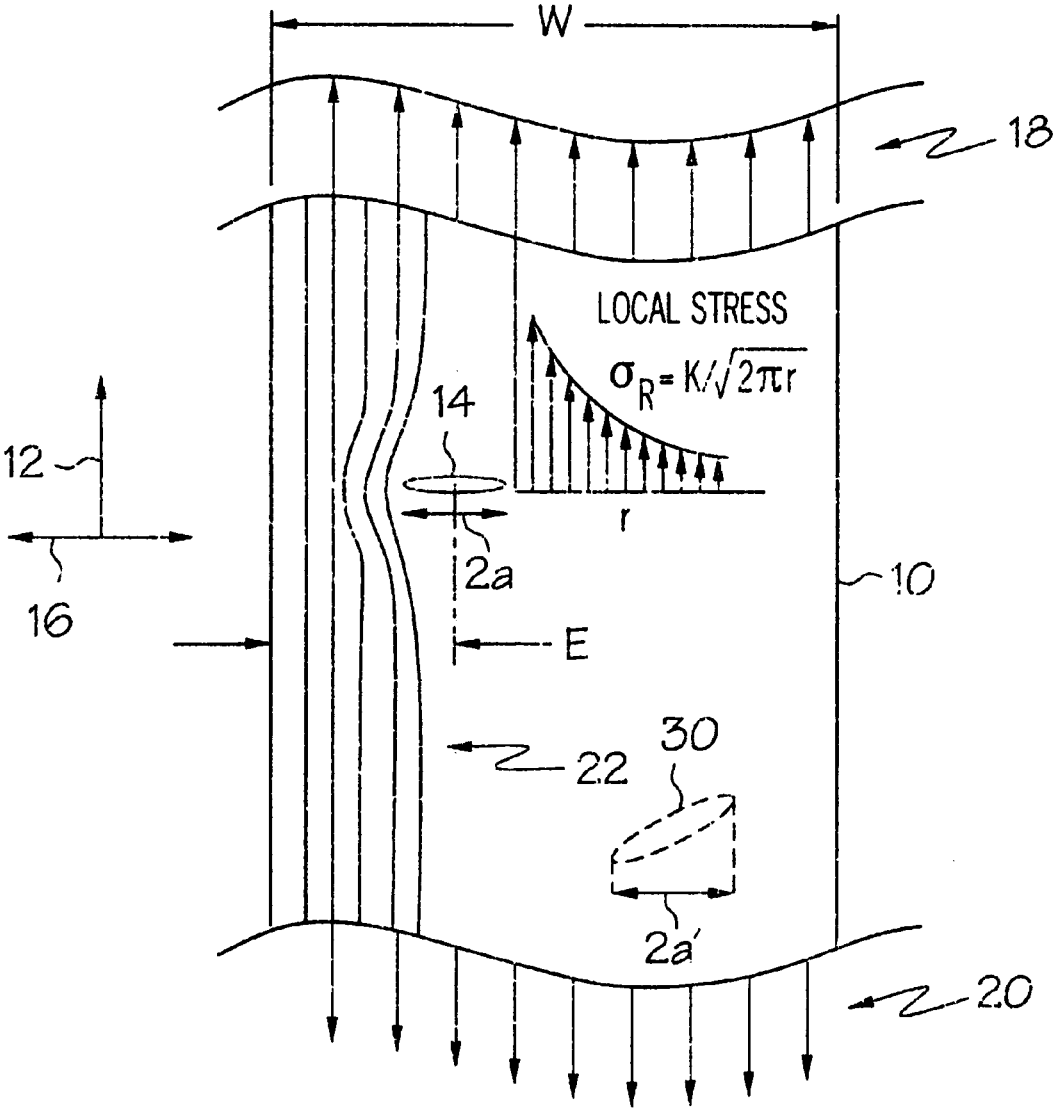
FIG. 1 shows schematically the stresses at a defect in a paper web.

Referring to the drawings, FIG. 1 illustrates a portion of a paper web 10 as it moves along an established paper path in a machine direction (MD) indicated by arrow 12, and containing a through web defect 14. As used throughout this specification, the terminology "cross machine direction" (CD) refers to a direction perpendicular to the machine direction 12 as shown by the double-sided arrow 16. The applied tension on the paper web as it moves along its established path is shown by arrows 18 and arrows 20. Imaginary load flow lines 22 illustrate the effect that the through web defect 14 has on the local stress field. As shown by the arrows under the stress curve 24 to the right of the through web defect 14, the stress near the defect is much greater than at points further removed from the defect. The through web defect 14 can raise the local stress high enough to cause failure, even if the applied tension 18, 20 is below the tensile failure stress of unflawed paper. The local stress field is governed by the size and shape of the defect and by its edge distance and, therefore, the relative strength is governed by the above variables. Thus, one way to improve productivity of paper making and paper processing machinery is to monitor the presence of through web defects in order to selectively repair such defects.

Applicants conducted a study which demonstrated the role which the distance of the through web defect 14 from the side edge of the paper web 10 plays in causing failure of the paper web 10 at the through web defect 14. In such tests 45# 956 raw stock paper was obtained and tested with a tensile test machine. Several hundreds of paper samples were tested with various types of through web defects, including cracks, round holes, elliptical holes, and irregular holes. Over 450 individual tests were conducted, with the results being shown in drawing FIGS. 2*a*–2*o*.

Figure 2A:
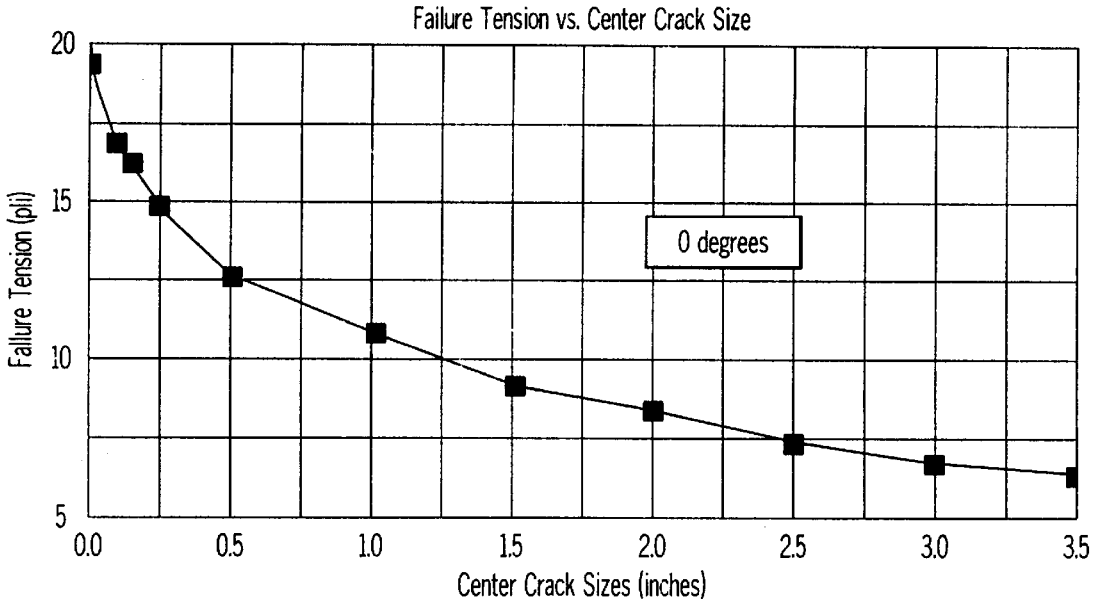
FIGS. 2*a*–2*o* depict graphs of failure test results for various through web defects of various sizes and at various edge distances.
Figure 2B:
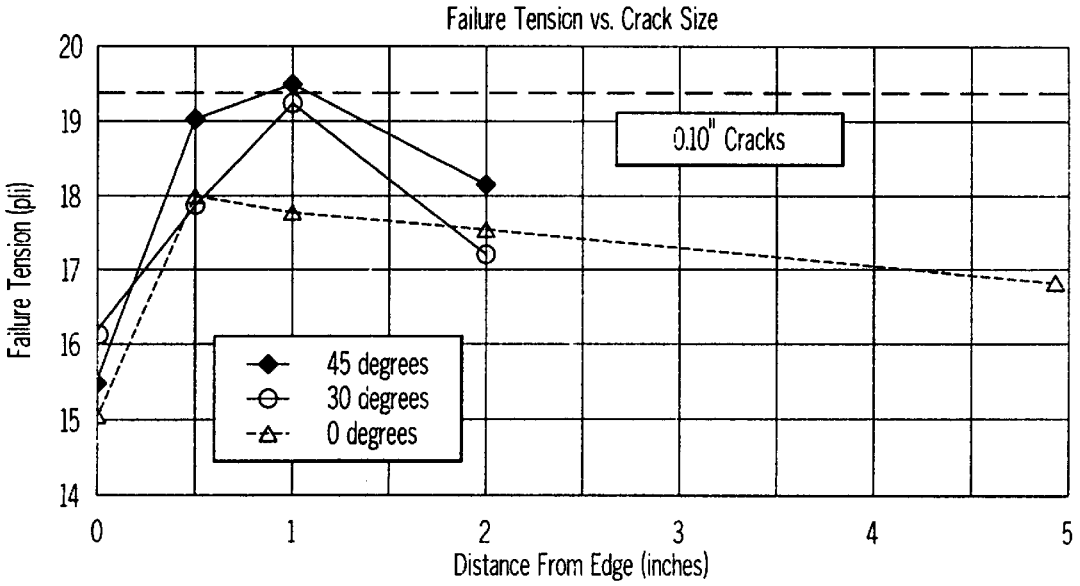
Figure 2C:
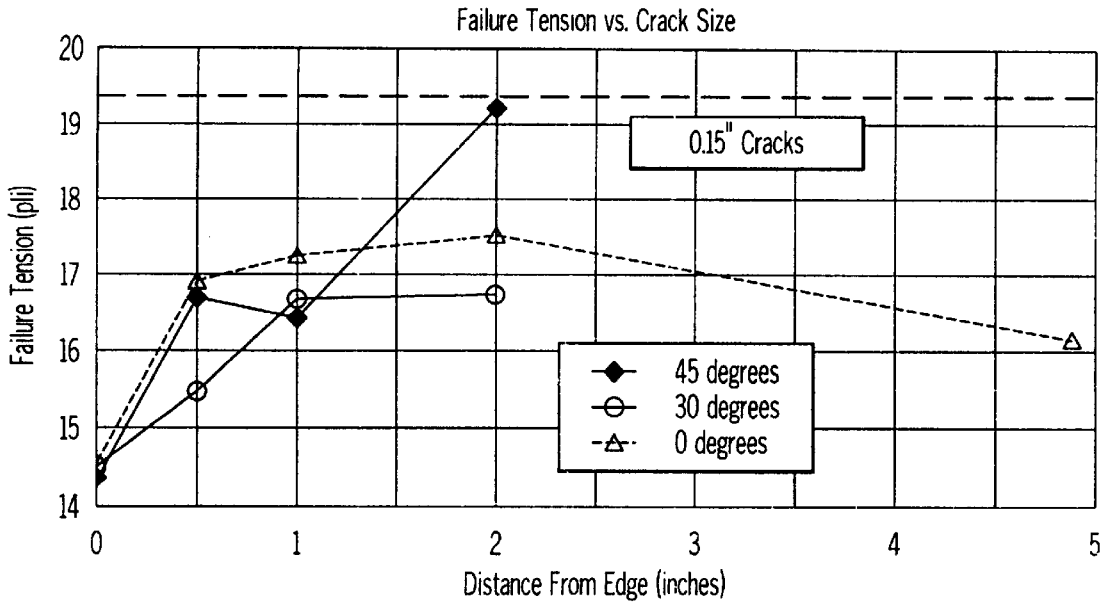
Figure 2D:
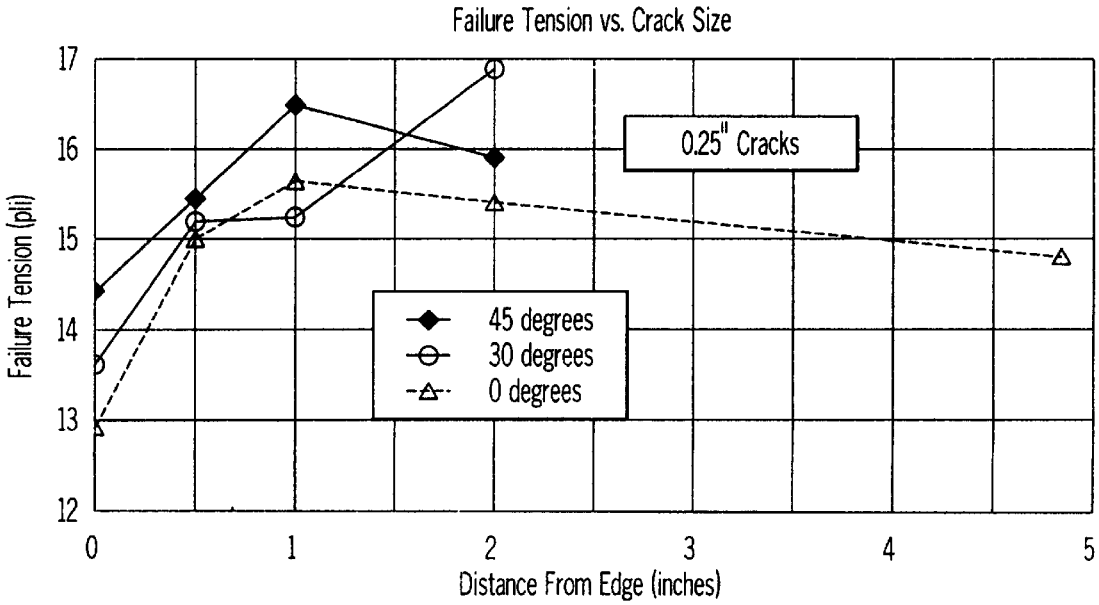
Figure 2E:
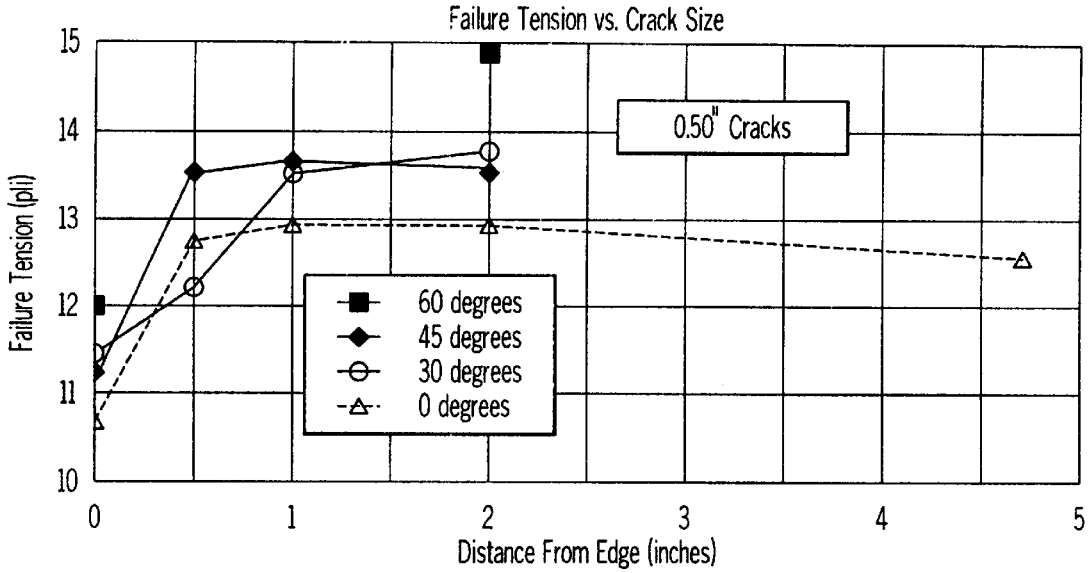
Figure 2F:
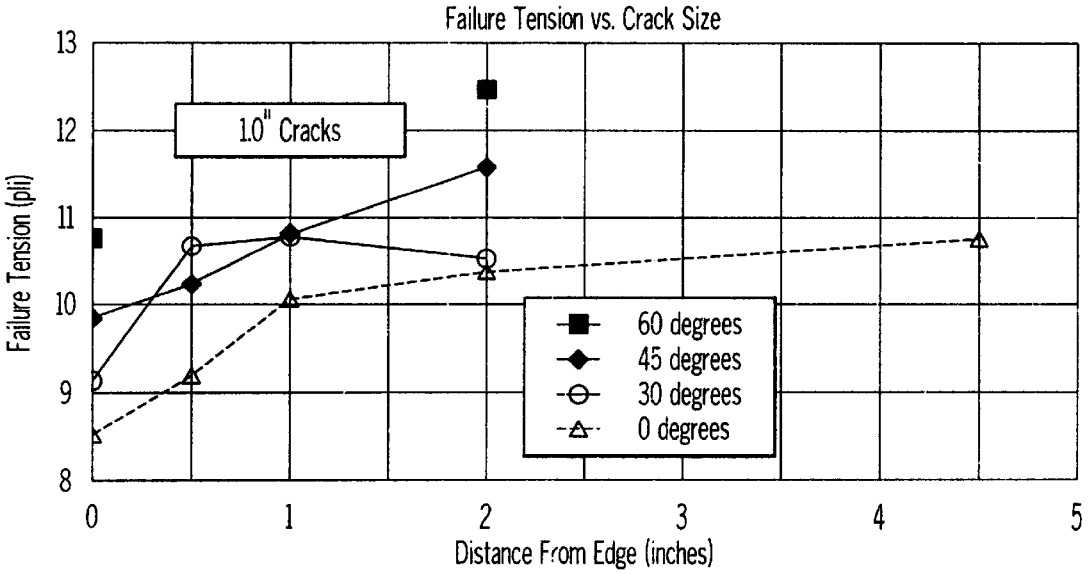
Figure 2G:
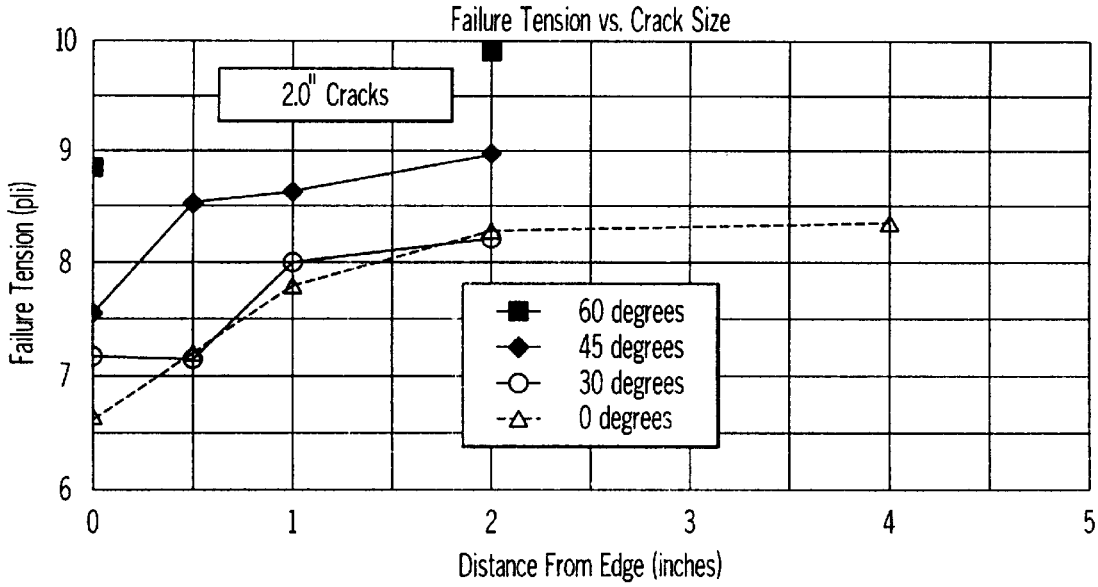
Figure 2H:
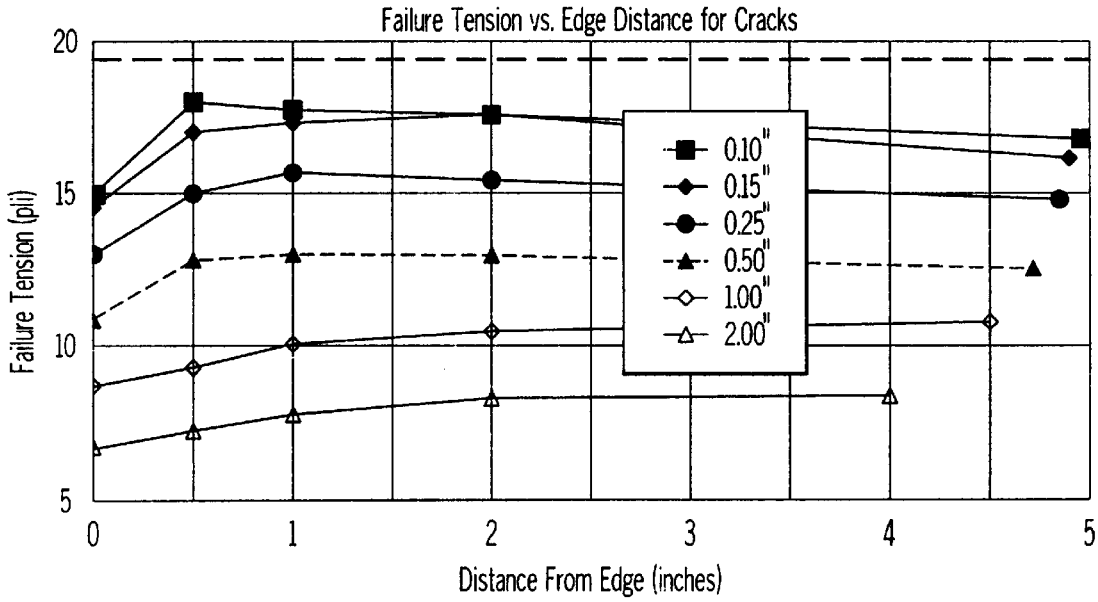
Figure 2I:
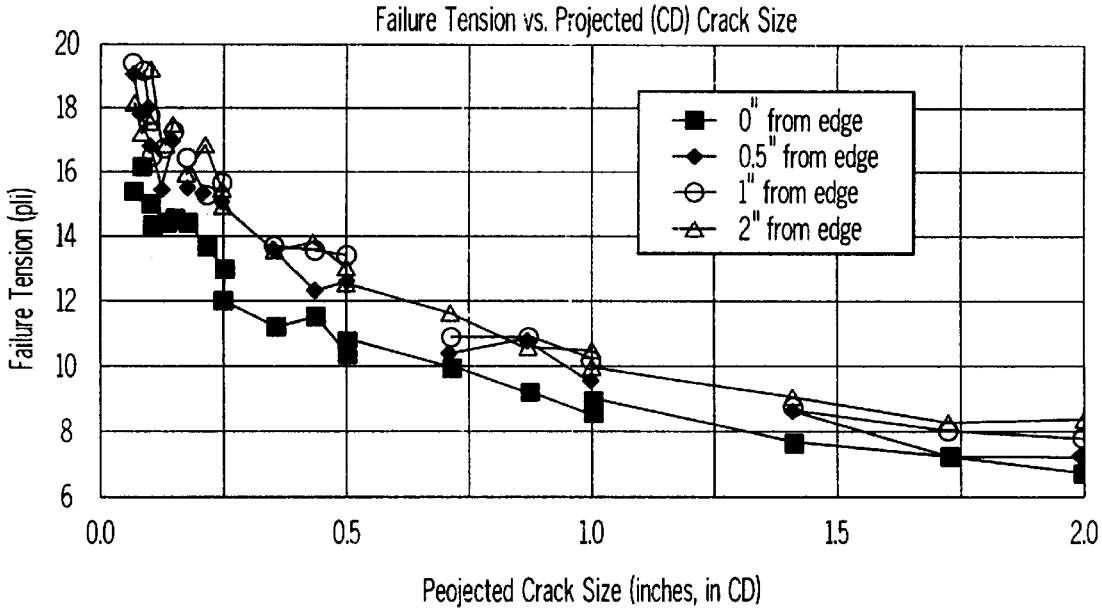

Referring to FIG. 2*a*, the graph of failure tension of the paper with various center crack sizes shows that as the CD size of the crack increases the failure tension decreases, such decrease occurring more rapidly as the CD size of the crack increases from 0 to about 1.5 inches and decreasing at a more gradual rate thereafter. FIGS. 2*b*–2*g* depict graphs of the test results for cracks of various CD dimensions and angles relative to the distance of such cracks from the side edge of the paper web. In this regard, the distance referred to is the CD distance from the side edge of the paper to the CD center of the crack. These graphs illustrate that the edge distance has a significant impact on failure tension of the paper, particularly when the cracks are located close to the paper edge. FIG. 2*h* summarizes FIGS. 2*b*–2*g* for horizontal cracks. The edge effect (yielding lower sheet strength) occurs for roughly 2 inches from the side edge of the paper. FIG. 2*i* shows that utilizing the projected crack CD dimension gives good estimates of strength for angled cracks. Referring to FIG. 1 and the exemplary angled crack 30 shown in shadow, the term projected CD dimension refers to the CD distance between the defect points nearest the edges of the paper when the CD location of each of such points is projected into the same MD location as shown by the dimension labeled 2*a*′.

Figure 2J:
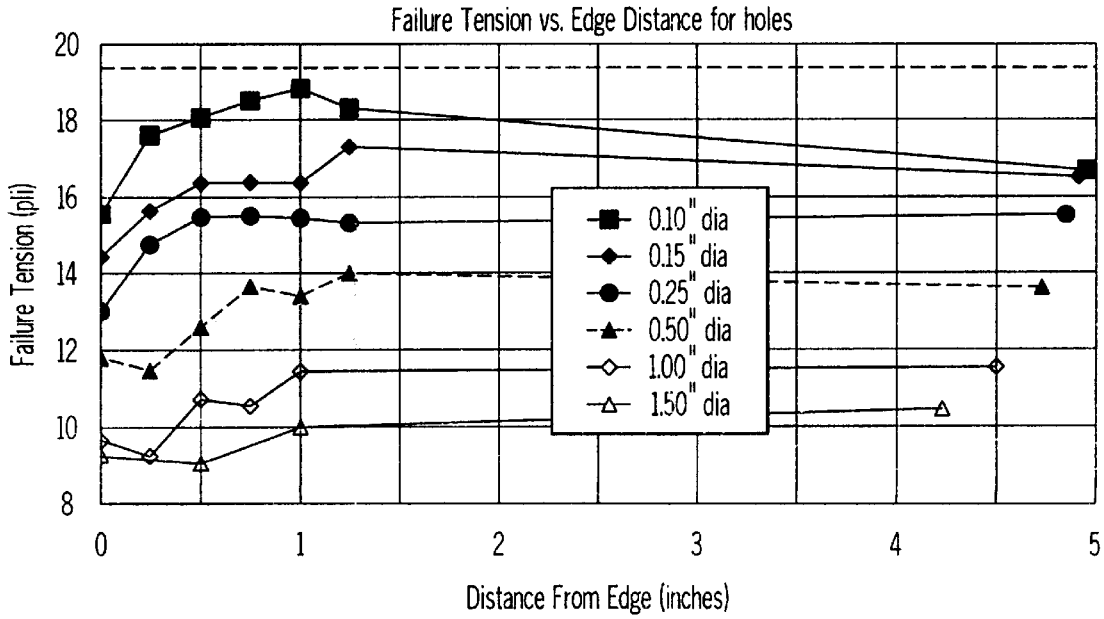
Figure 2K:
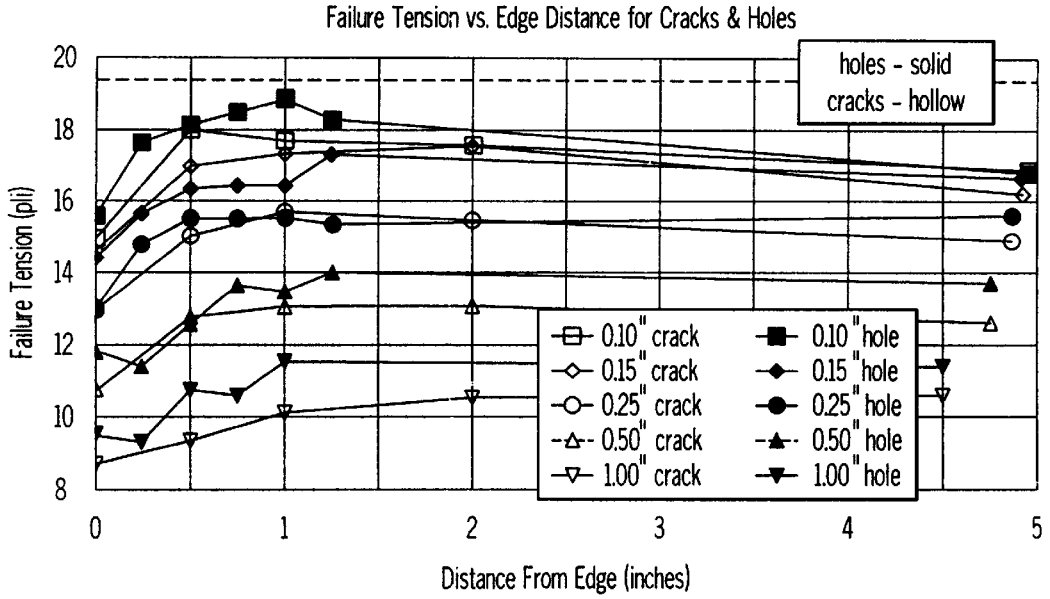
Figure 2L:
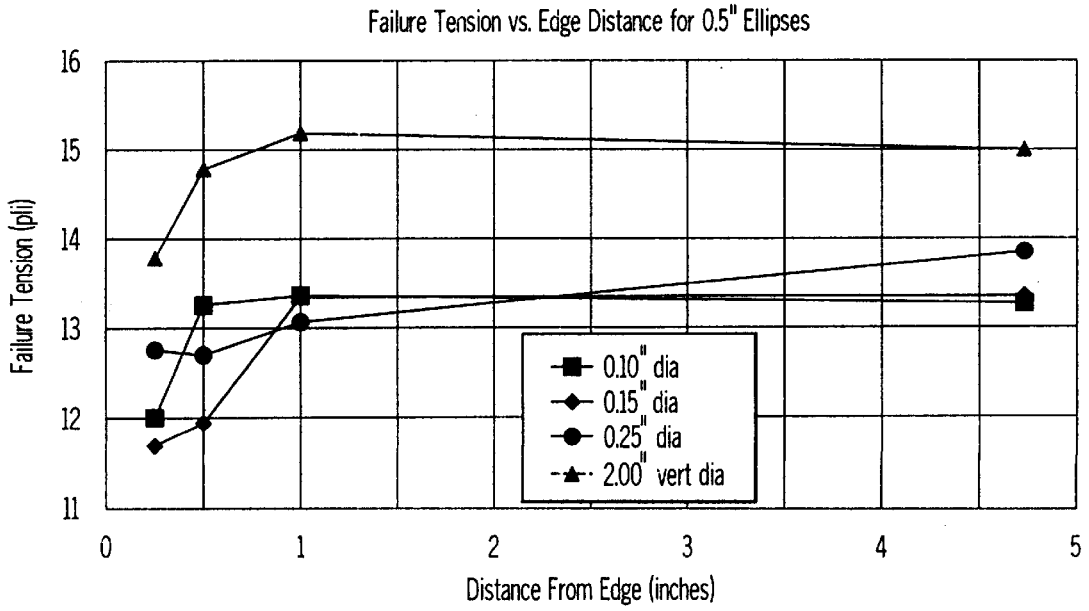
Figure 2M:
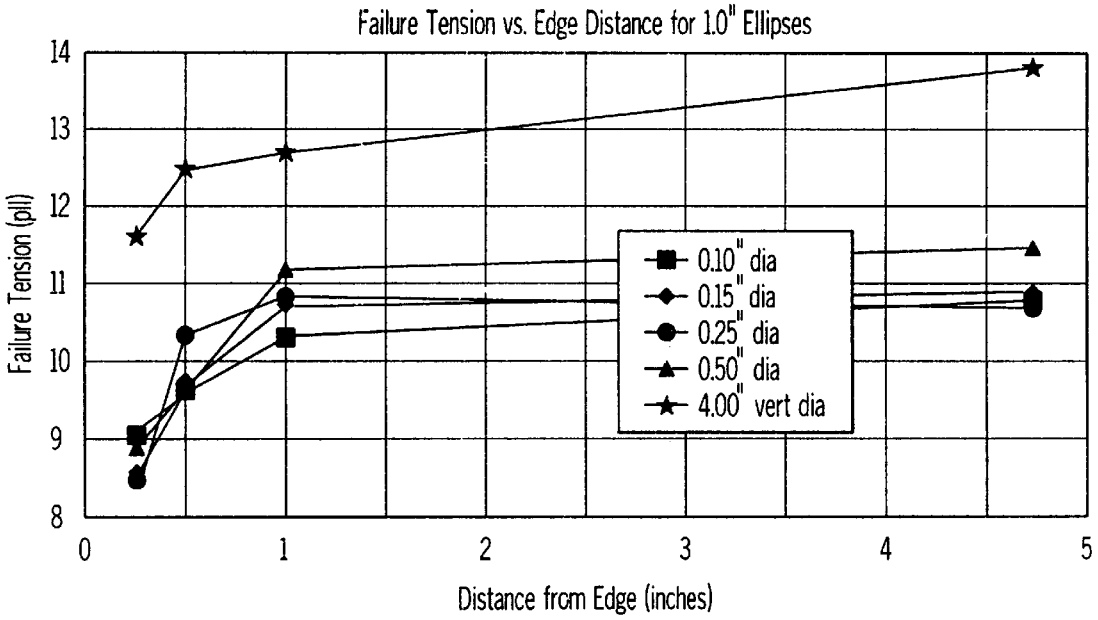
Figure 2N:
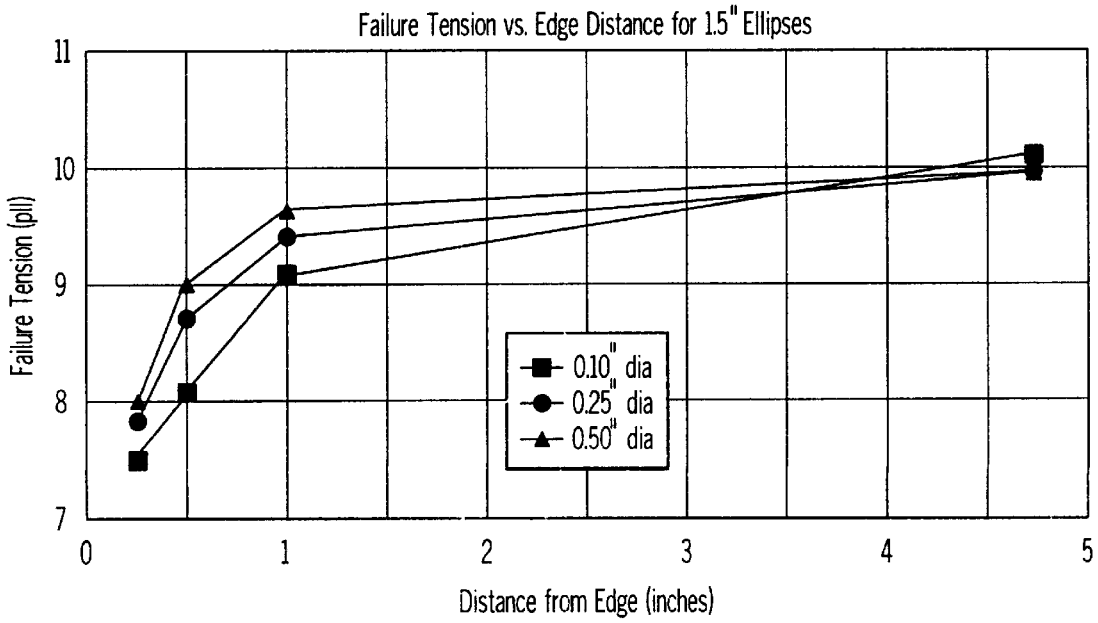
Figure 20:
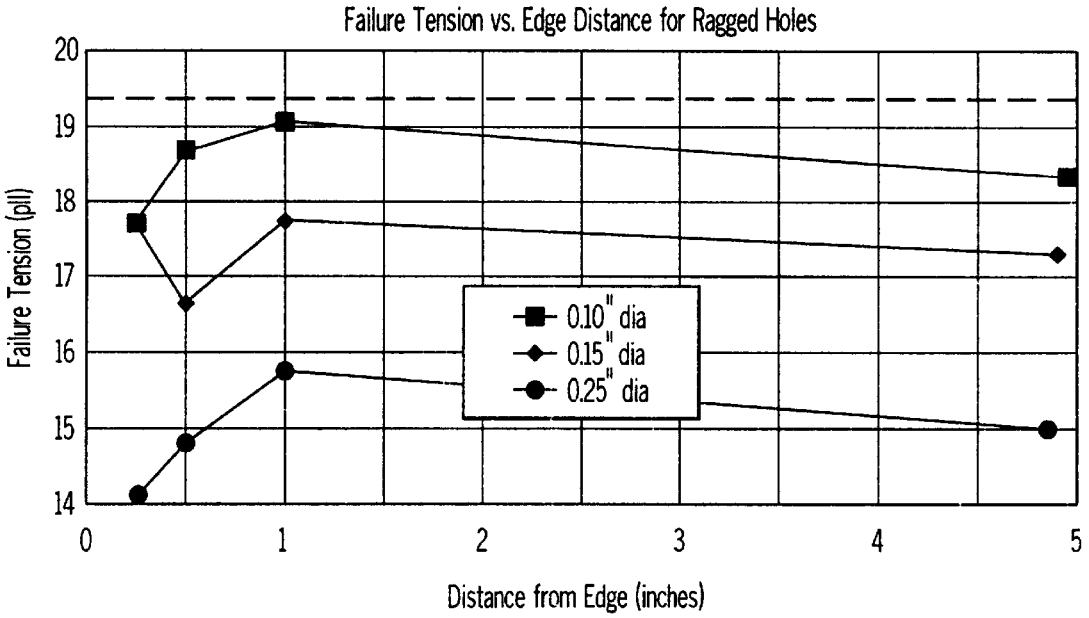

The failure tension for circular holes of various sizes versus the distance of such holes from the edge of the paper is shown in FIG. 2*j*, and again the edge effect can be noted. This graph reflects the average between tests with clean holes, and duplicate tests with the holes having the small slit cut in the CD on the edge of the hole nearest the side of the paper. A comparison of the test results for cracks and the test results for holes is depicted in the graph of FIG. 2*k* and demonstrates that cracks (based on CD dimension) are only slightly more detrimental than the same size circular holes (based on diameter). Similar test results for various size ellipses are depicted in FIGS. 2*l*–2*n*, with various size hole punches utilized to form the ends of the ellipses. The final graph, FIG. 2*o*, depicts the test results for ragged or irregular holes of various sizes.

The test results for all of the above defect types generally indicate a dramatic decrease in failure strength as the defects approach the side of the paper. Fracture mechanics was then used to develop appropriate equations to account for the edge effect parameter of the defects as follows. Consider a crack in a sheet. If it is an edge crack, its length is denoted by a. Otherwise, the crack has two tips and, by convention, its size (CD dimension) is denoted as 2*a*. In an x-y coordinate system, where y is along the MD and x is along the CD, the stress at the crack tip in the direction (y) of the applied stress or load is given by:

$$\sigma_y = \frac{K}{\sqrt{2\pi x}} = \beta\sigma\frac{\sqrt{\pi a}}{\sqrt{2\pi a}} \qquad \text{Equation 1}$$

$$K=\beta\sigma\sqrt{\pi a} \qquad \text{Equation 2}$$

In these equations, K is called the stress intensity factor, a is the crack size, σ the remote (applied) stress, and x the distance from the crack tip. Finally, β is a geometry factor. It depends upon the configuration and structural details of the crack. Fracture occurs when K reaches a critical value $K_c$. This $K_c$ is called the toughness or, in the case of paper, the tenacity. It is a material property and only one test is needed to measure it. For example, use a wide paper sheet with a center slit of say 2*a*=2 inches. In that case, β=1. Pulling the sheet to fracture and measuring the remote (applied) stress σ at which fracture occurs enables $K_c$ to be calculated utilizing Equation 2 above. With the tenacity known, the applied stress for fracture can be calculated for any other case with known β utilizing Equation 3:

$$\sigma = \frac{K_c}{\beta\sqrt{\pi a}} \qquad \text{Equation 3}$$

The problem with Equation 3 is that it does not work for very small defects (where a approaches zero). This problem can be solved by defining an effective K, named $K_{eff}$ as follows:

$$K_{eff} = \beta\sigma\sqrt{\pi a + \frac{K_{eff}^2}{aF_{tu}^2}} \qquad \text{Equation 4}$$

Squaring this equation and taking terms with $K_{eff}$ squared together provides:

$$K_{eff}^2\left(1 - \frac{\beta^2\sigma^2}{aF_{tu}^2}\right) = \beta^2\sigma^2\pi a \qquad \text{Equation 5}$$

Tenacity can then be redefined in terms of $K_{eff}$ as:

$$H_{ceff} = \frac{\beta\sigma\sqrt{\pi a}}{\sqrt{1 - \frac{\beta^2\sigma^2}{aF_{tu}^2}}} = \frac{K_c}{\sqrt{1 - \frac{\beta^2\sigma^2}{aF_{tu}^2}}} \qquad \text{Equation 6}$$

where $K_c$ is the normal definition of tenacity and $F_{tu}$ is the tensile strength of the paper with no defects. Fracture occurs when $K_{eff}$=$K_{ceff}$, so that the fracture stress follows as:

$$\sigma_{fracture} = \frac{K_{ceff}}{\beta\sqrt{\pi a + \frac{K_{ceff}^2}{F_{tu}^2}}} \qquad \text{Equation 7}$$

Note that the above equation properly predicts the fracture stress as σ=$F_{tu}$ when a=0 (β=1). For larger a, the correction gradually loses significance and the original equation 3 essentially applies.

Predictions for Center Cracks

Figure 3:
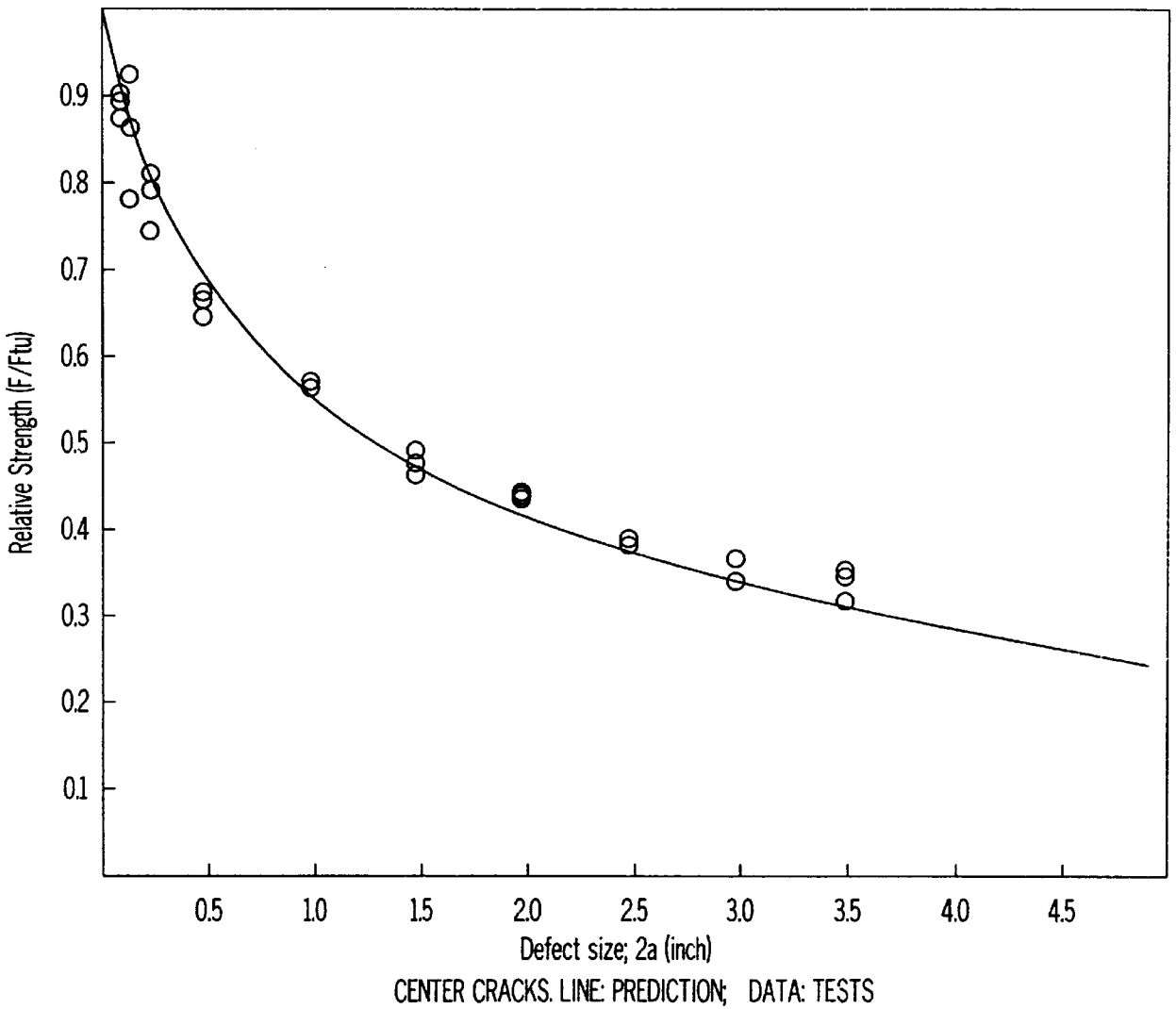
FIG. 3 depicts a graph of predicted relative strength and tested relative strength of paper with various center crack sizes.

Thirty tests were done on specimens with center cracks of various sizes to obtain the tenacity value and to show the soundness of the basic procedure. The average tenacity as calculated by Equation 6 was 16.08 pli $(in)^{1/2}$, with a scatter of less than 10%. Using this value, the results were predicted over the entire range, and they are shown in FIG. 3. Note that the line is the predicted response and the test results are shown as data points. The subject graph shows the prediction to be very good, and generally within 10%

Accounting for Edge Distance

The entire affect of geometry is included in the geometry factor β. For a center crack, only the width W of the panel (paper web) is involved. For that case β is simply:

$$\beta = \sqrt{\sec\frac{\pi a}{W}} \qquad \text{Equation 8}$$

If W is substantially greater than a, this equation returns β=1. In a paper web, β=1 for all central defects of interest. Because the total center crack is defined as 2*a,* actually the half crack size appears in Equation 8.

For an edge crack, β=1 for all small crack sizes of interest. If W is small, Equation 8 must be expanded with more terms, but for the purpose of most paper webs, these can be neglected. An important difference is, however, that in the expression for K, the total crack size must be used. For example, consider a crack of 1 inch in a very wide panel or paper web. If this is a center crack, then 2*a*=1 inch and a=0.5 inch, so that K=1.25σ. But if this same crack is at the edge, then a=1, and β=1, so that K=1.77σ.

The eccentricity of a crack is also a matter of geometry and, hence, of β. This β importantly includes additional factors to account for the eccentricity of the defect from the center of the paper as follows:

$$\beta = 1 + \left(0.6 + 0.8\frac{E}{W}\right)\left(\sqrt{\sec\frac{\pi a}{2E}} - 1\right) \qquad \text{Equation 9}$$

where E is the distance from the nearest edge to the CD center of the crack. It can be seen that when a crack is in the center, E=W/2, and the equation reduces to Equation 8 above.

For smooth holes and ellipses, a small correction to β was found to be appropriate. This correction depends upon the acuity of the defect's edge, which means that it depends upon the stress concentration $K_t$ of the defect. However, this is of relevance only for the explanation of some of the test results, because holes in the paper web are always of irregular shape.

Figure 4:
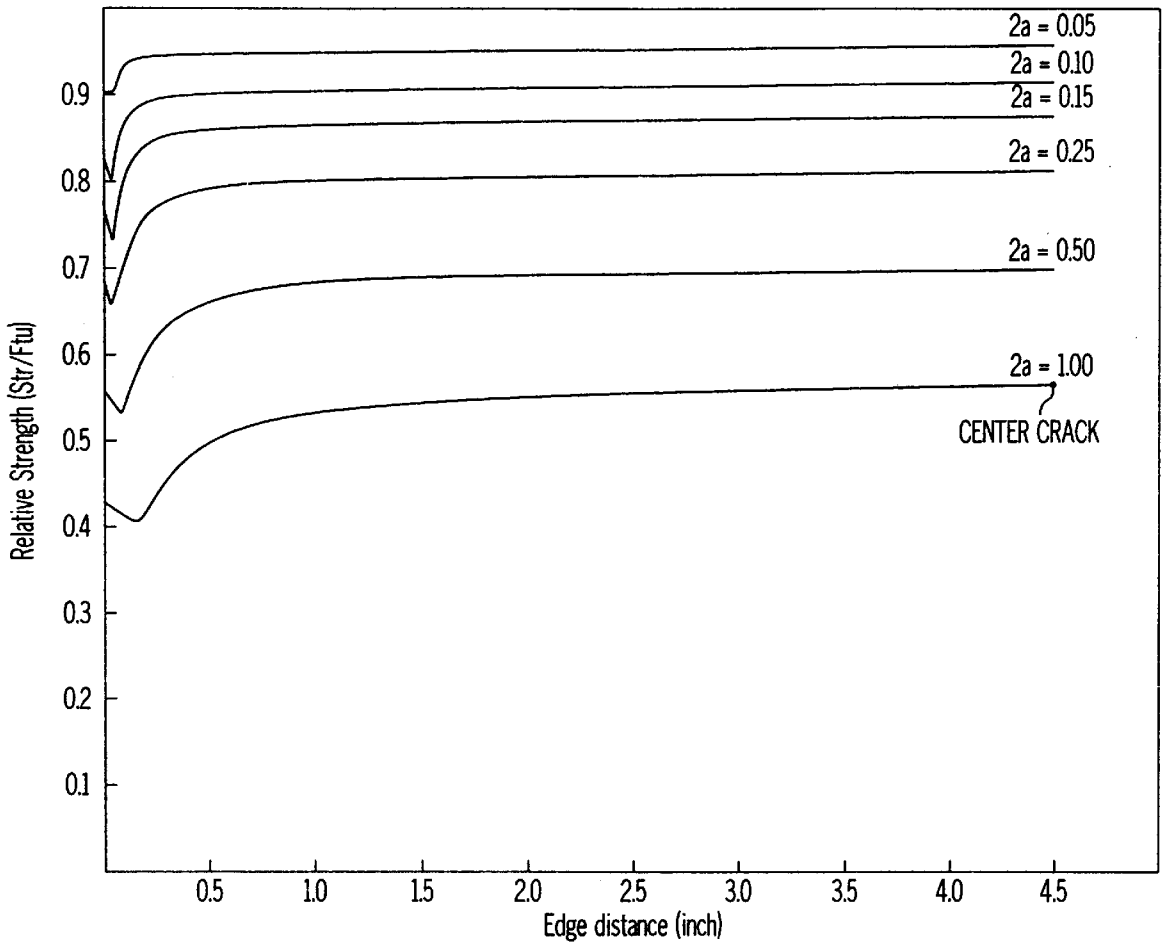
FIG. 4 depicts a graph showing the effect of edge distance on relative strength for cracks of various sizes.

It has been shown convincingly that the analysis used above can predict almost any situation. Therefore, it is possible to generalize the procedure for all hole like defects by simply applying the analysis to provide curves showing the effect of defect size and edge distance. The angle of the defect has been shown to be dealt with by simply using the projected size of the defect as discussed above. FIG. 4 shows the effect of edge distance on cracks of various sizes in the 10 inch wide test specimens used above. This graph confirms the general trend of the test data as shown in the data plots in FIG. 2.

One point that should be clarified in connection with the above analysis is the following. Utilizing Equation 7 in conjunction with the β Equation 9 gives the stress for failure of the ligament adjacent the crack tip or defect edge nearest the side edge of the paper. Once the ligament breaks, a new situation develops, namely that of an edge crack of size:

$$a_{edge} = \text{EdgeDistance} + 2a_{old} \qquad \text{Equation 10}$$

with β=1. The strength of this new edge crack (evaluated again by Equation 7), may well be higher than that of the ligament. If so, then it is possible that the ligament may fail without causing the entire paper web to fail. In order to account for this possibility, for each defect Equation 7 is evaluated twice, once using Equation 9 for β and once using the $a_{edge}$ value of Equation 12 and a β=1. If the latter gives a higher result, this higher result is what counts in determining whether the defect is likely to cause complete web failure.

Figure 5A:
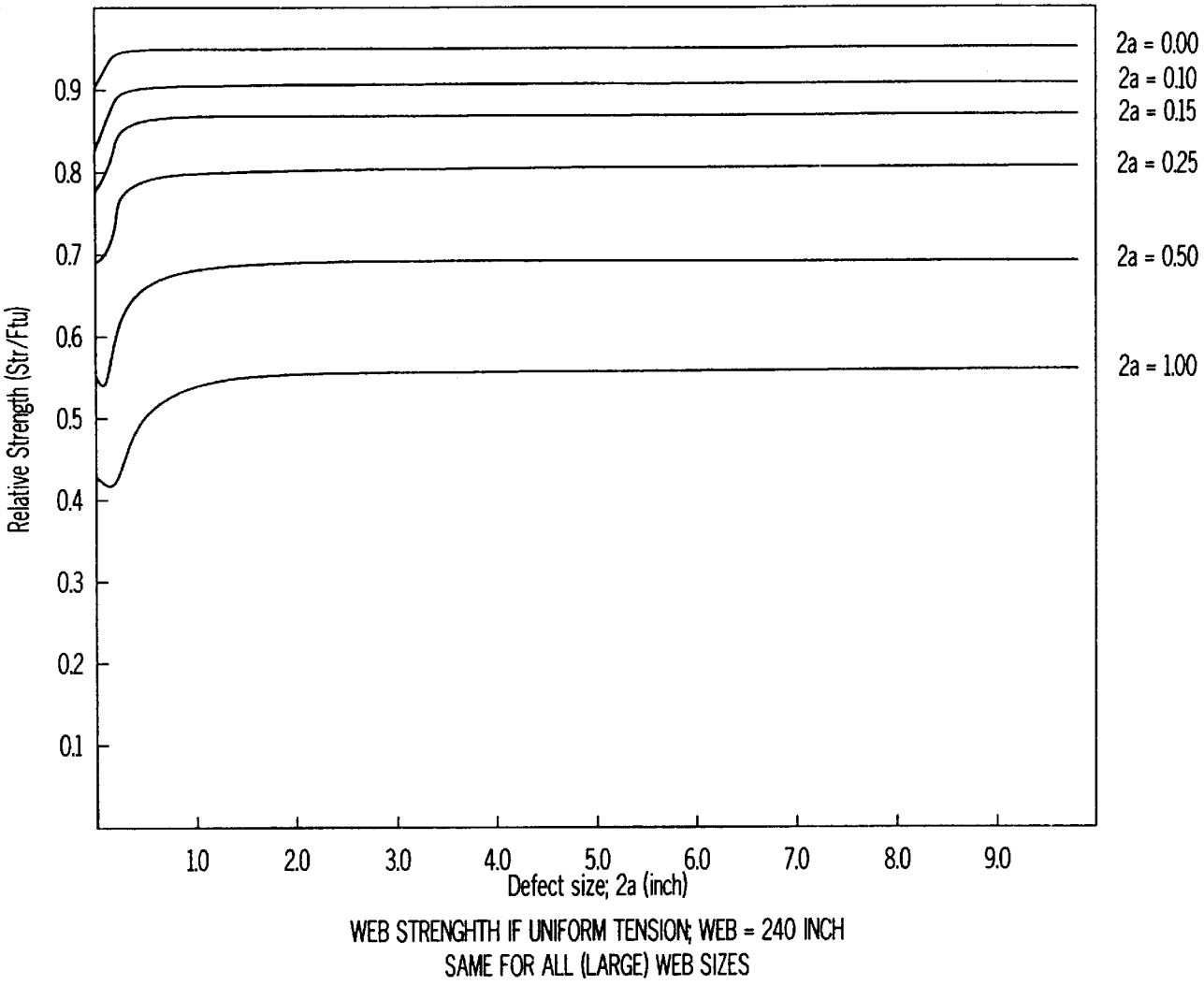
FIGS. 5*a*–5*b* depict graphs of relative web strength.
Figure 5B:
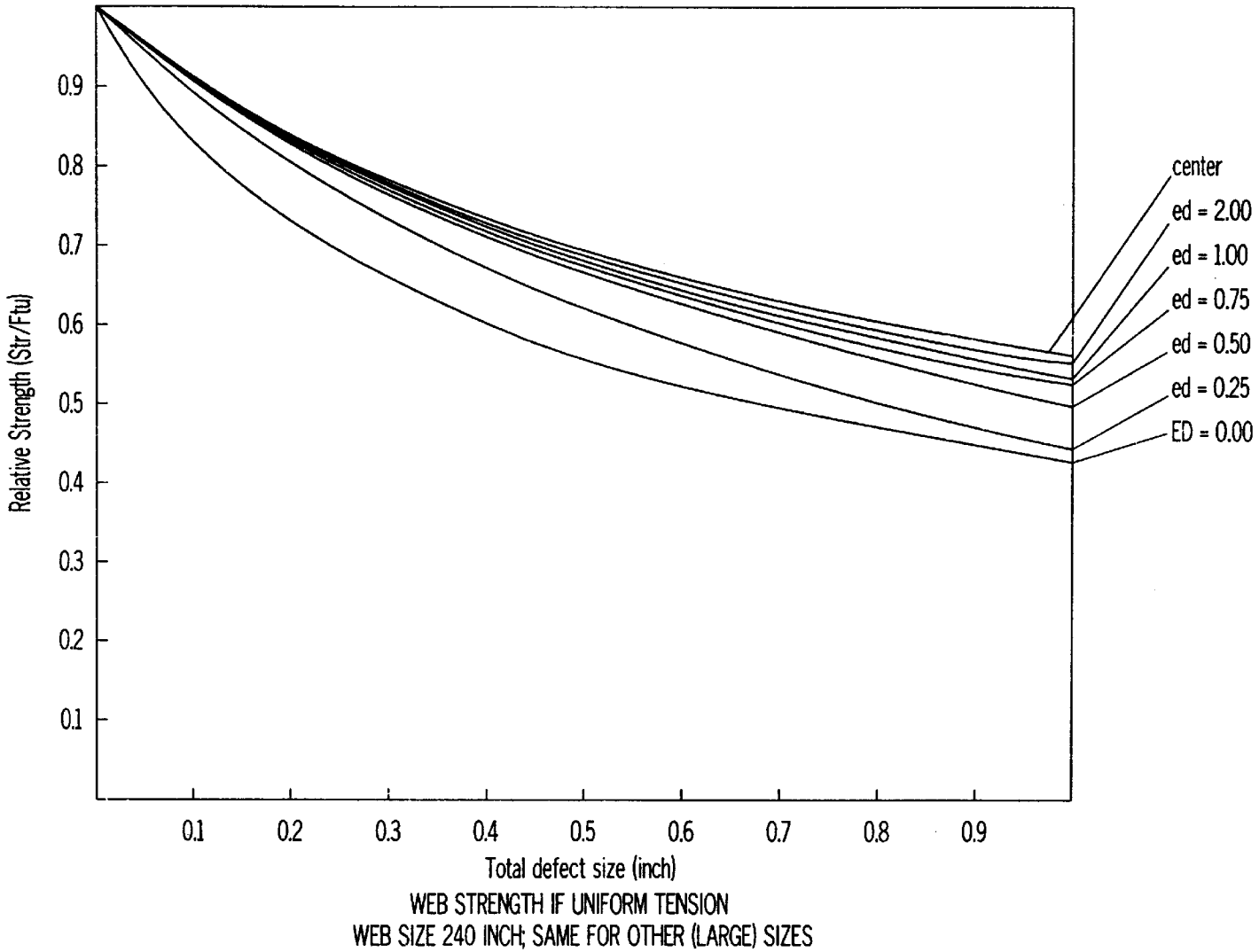
Figure 6A:
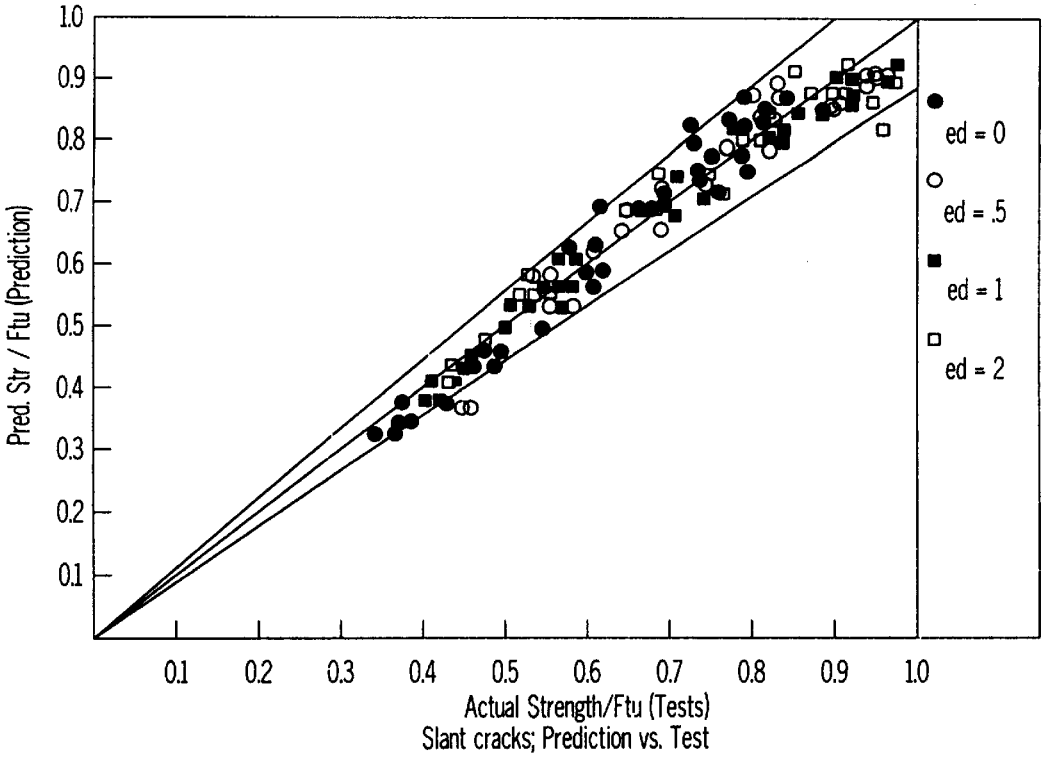
FIGS. 6*a*–6*e* depict graphs of predicted relative strength for slant cracks, holes, and irregular defects.
Figure 6B:
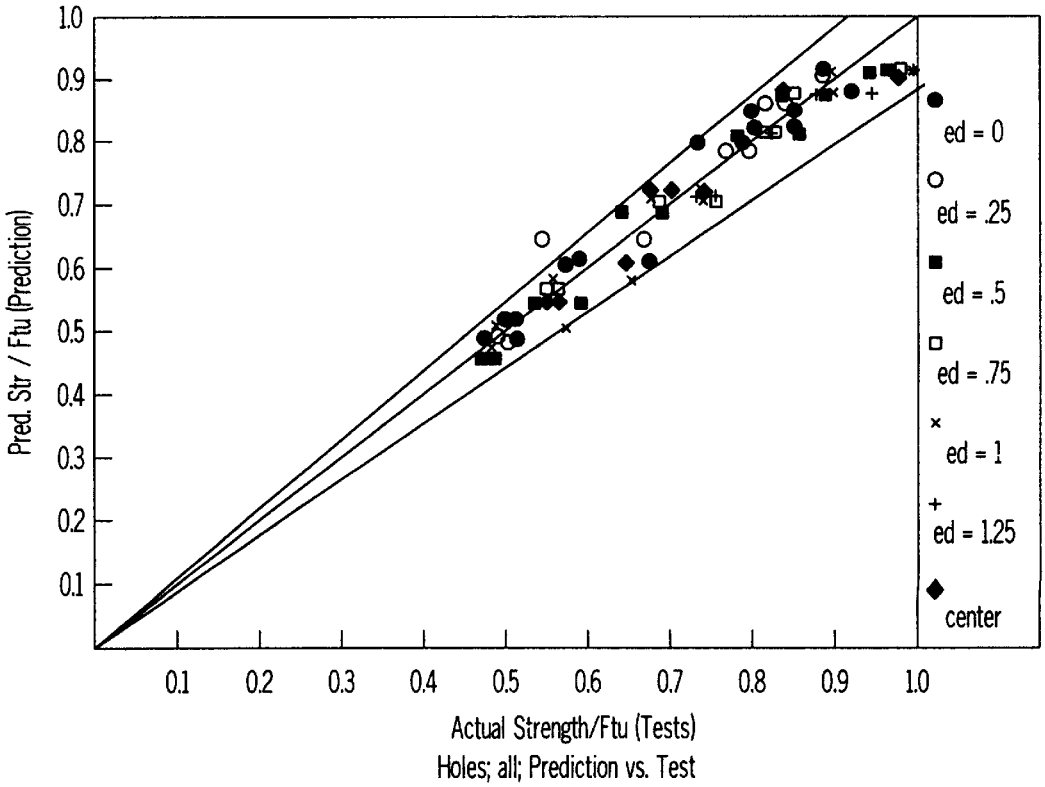
Figure 6C:
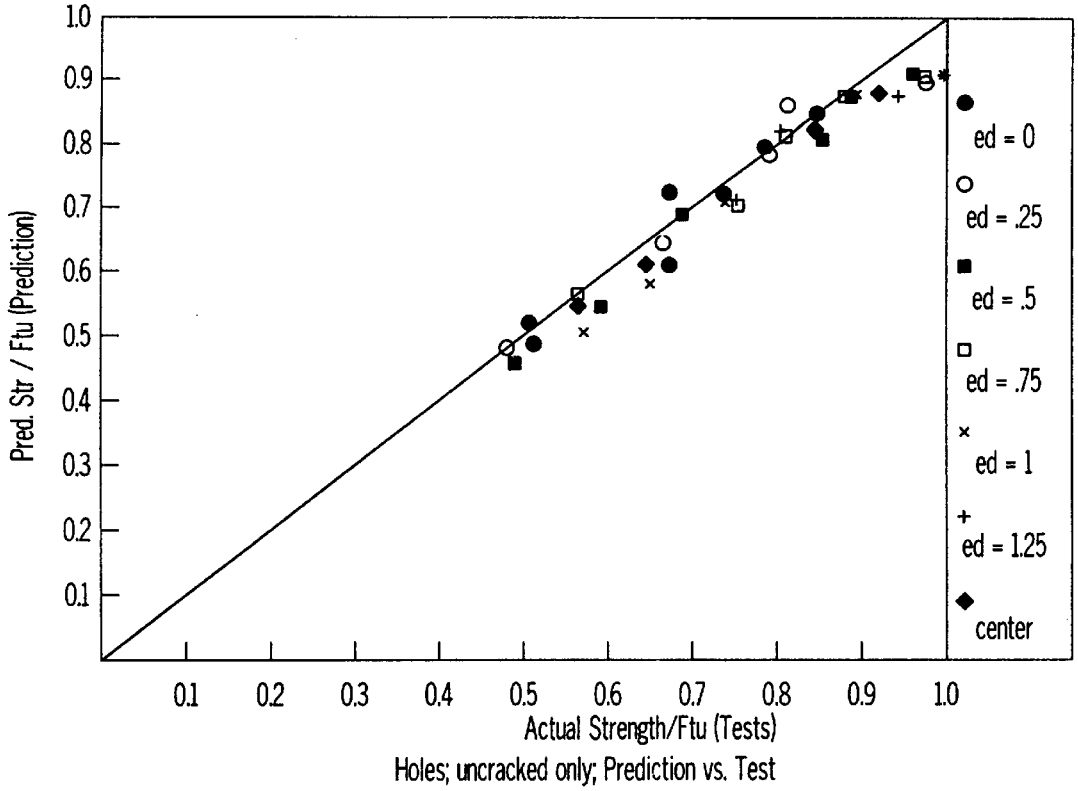
Figure 6D:
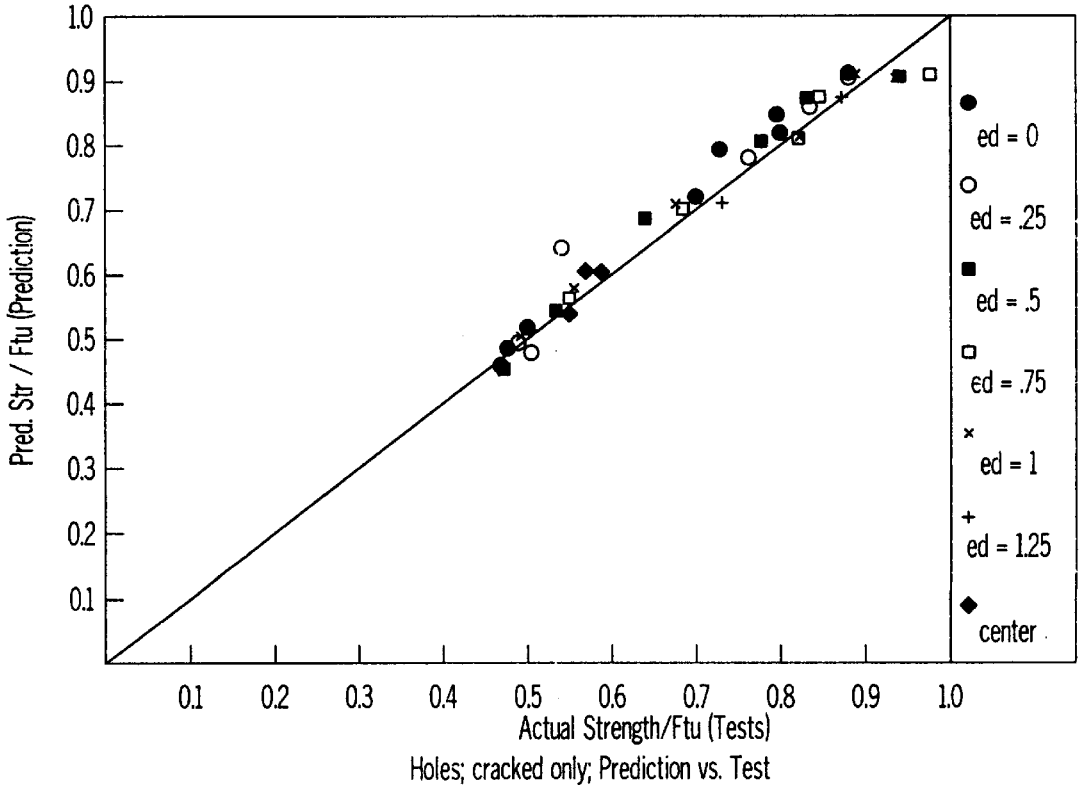
Figure 6E:
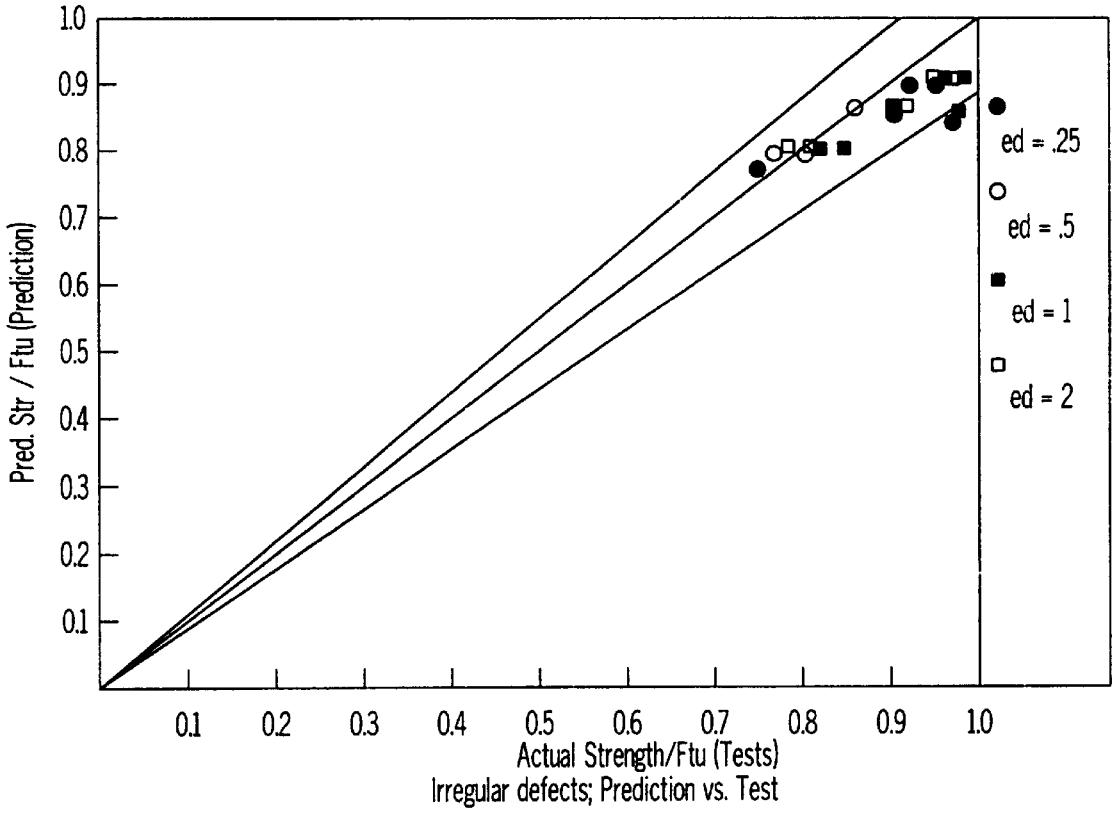

Using the fracture mechanics analysis predictions of the effects of defect size and edge distance for large paper webs the graphs of FIGS. 5*a* and 5*b* were developed. FIG. 5*a* shows the relative strength of the web versus the distance of the defect from the edge of the web for various defect sizes. FIG. 5*b* shows the relative strength of the web versus the defect size for various distances from the edge of the web. These figures demonstrate that the equations can form the basis for making decisions about which through web defects to repair based upon both size (CD dimension) and CD distance from the side edge of the paper web.

Similarly, referring to FIGS. 6*a*–6*e,* graphs of predicted relative strength verses actual relative strength for slant crack (FIG. 6*a*), all holes (FIG. 6*b*), uncracked holes (FIG. 6*c*), cracked holes (FIG. 6*d*), and irregular defects (FIG. 6*e*) are shown. The center line of each graph represents the centerline from the origin represents the predicted relative strength and the data points represent actual relative strength. The two additional lines extending from the origin of FIGS. 6*a,* 6*b,* and 6*c* represent a ten percent deviation from the predicted values. Thus, it is seen that for all defects, the relative strength predictions using the above analysis are very reliable, and almost always within ten percent or less of the actual relative strength.

Real Time Implementation

Figure 7:
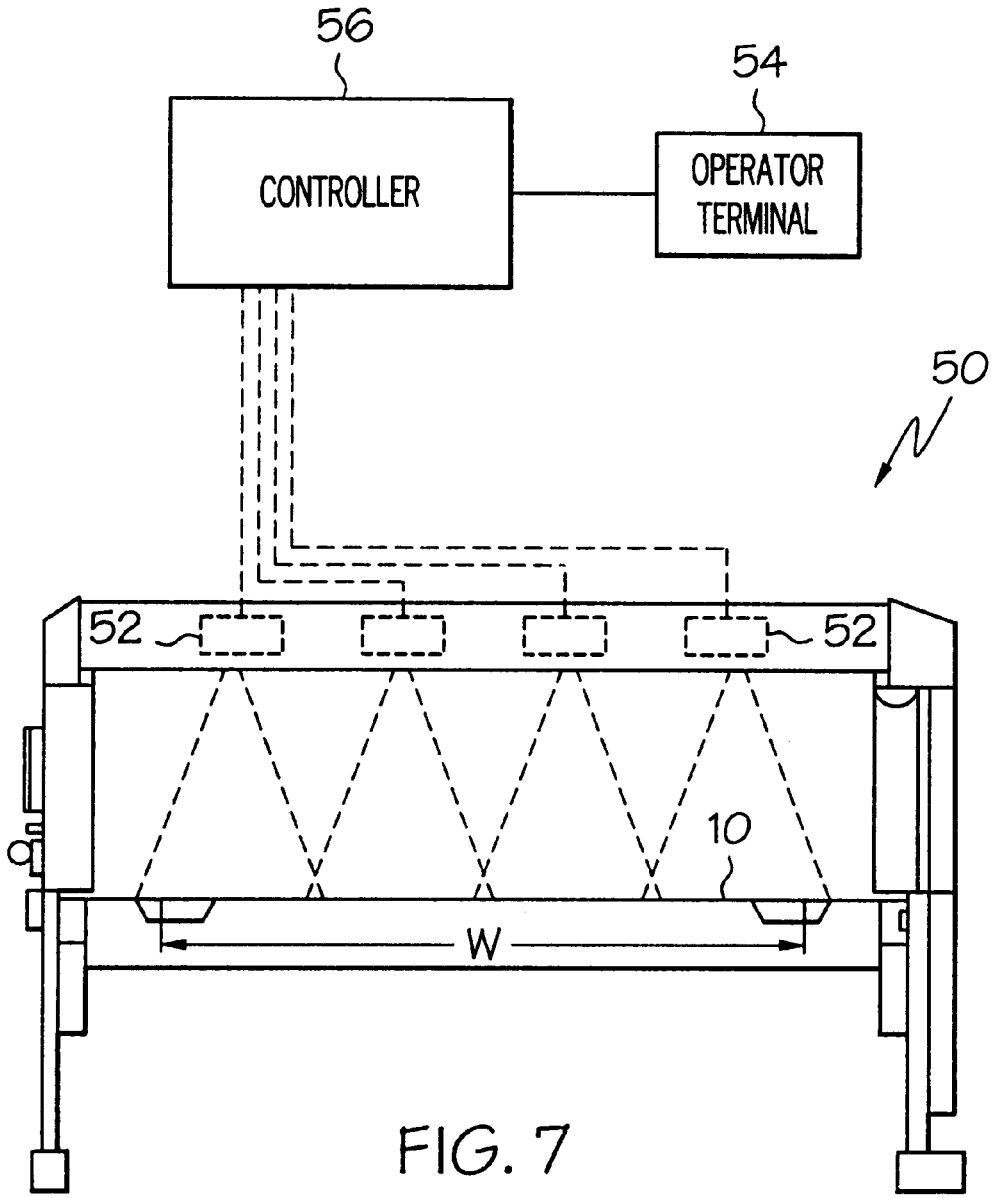
FIG. 7 depicts a schematic representation of a system of the present invention.

Implementation of the techniques discussed above involves the use of a defect detection device capable of detecting through web defects as the paper web moves along its established paper path through the paper making machine. Various devices for such defect detection are available. In one preferred embodiment of the present invention the MXOpen™ Web Inspection System Frame (model 6410) available from MEASUREX, One Results Way, Cupertino, Calif. 95011 may be utilized. This system includes sealed extruded aluminum beams which may be integrated with the process machinery using steel support stands. The beams house both a light source and a plurality of charge couple device (CCD) cameras. The light source illuminates defects and the cameras detect the web imperfections. A schematic diagram of such a system 50 is shown in FIG. 7 where the paper web 10 moves in a machine direction (defined as into or out of the paper). The CCD cameras 52 are shown above the paper web 10 and include overlapping fields of vision in order to assure that the entire width W of the paper web is monitored or scanned. This system 50 may include a video display/operator terminal 54 also available for MEASUREX, for interactive communication and control of the system. Complete visibility of web defects and quality status are provided on display 54 by a controller 56 which may comprise MXOpen™ Inspection Manager likewise available from MEASUREX. The controller 56 can include appropriate software to implement the monitoring of the present invention as discussed in more detail below. The defect detection device would typically be placed in-line with the paper making machine for detecting defects as the paper is made.

Figure 8:
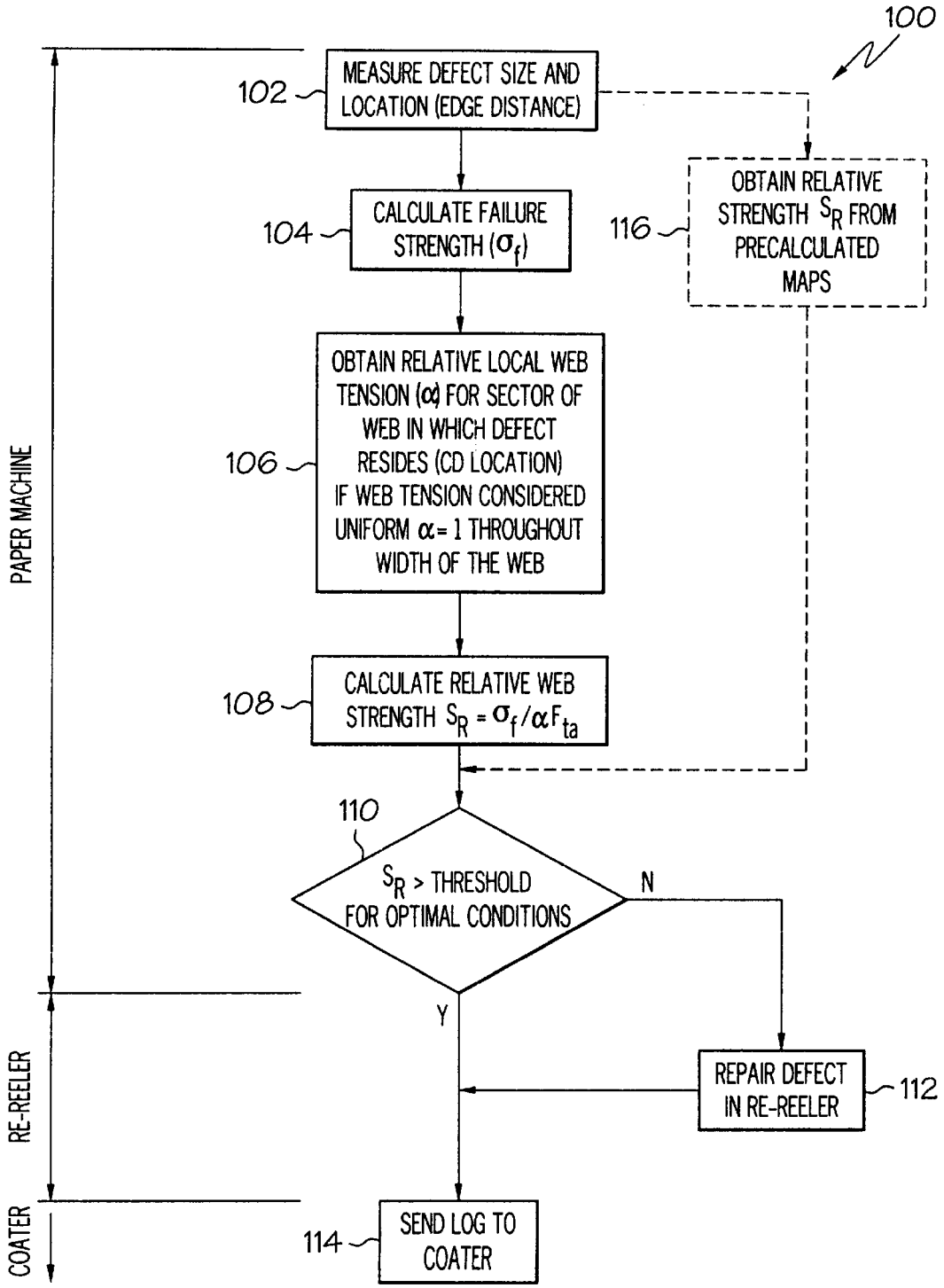
FIG. 8 is a high level flow chart of one embodiment of a method of the present invention.

A flow chart 100 illustrating the operation according to one embodiment of the invention is shown in FIG. 8. As indicated in block 102 the defects, in the running web in the paper machine, are detected by means of the MEASUREX system described above. Those measurements relevant to strength, namely defect size and location in cross machine direction (CD) are fed into the monitoring computer controller.

The computer software then calculates the failure strength, using the equations provided above, on the basis of the relevant measurements, as shown in block 104.

Whether or not a certain defect could cause a web break in the coater depends upon size and location of the defect as explained above. However, it also depends upon the tension in the web. The higher this tension, the more likely is a failure. The web tension is by no means constant. In the context of the present invention, most important is its variation in CD direction. For example, the tension at the edges of the web may be higher or lower than the average. Local tension variations are caused, in part, by so called residual stresses introduced by local variations in moisture and temperature during the drying process in the paper machine and the coater. The strength of a defect-free web is inversely proportional to the local tension. It means, that in turn, the relative strength of the web with a defect is inversely proportional to the local tension. This is indicated by the factor in block 106

Subsequently, the computer calculates the relative strength as shown in block 108. In other words, taking into account the effect of defect size and edge distance on strength, as well as the fact that the effect on strength of any defect depends upon local web tension, the computer calculates how much the strength is reduced (as a fraction or as a percentage) by the presence of the defect at the CD location it resides.

Alternatively, all calculations made in blocks, 104, 106, 108 may be done a priori for a variety of circumstances and compiled in charts. Then, instead of the computer performing the calculations in real time (blocks 104, 106, 108 ) the computer or the operator would evaluate the effect of the defect on relative strength by interpolation in the pre-calculated charts, as shown in block 116. Whereas this is a realistic alternative it is included as part of the invention. In realty, present day computer speeds likely make this alternative the slower one.

Once the effect on relative strength has been calculated, a decision must be made as to whether or not the defect should be repaired during the re-reeler operation. This decision making process is represented by block 110. Here, the software provides preset options from which the machine operator can select. All these options are considered part of the invention. The operator can set a threshold for the acceptable loss of relative strength on the basis of:

a. an acceptable number of coater web-breaks per unit time;

b. an acceptable number of breaks per unit of production; or c. optimized number of breaks in the trade off between the cost of breaks and the cost of (too many) repairs.

Depending on this chance (made a priori) the software will automatically identify those defects that should be repaired, such as by initiating a control signal which alerts the operator and/or marks the web at the web defect. It is also anticipated that in a wholly integrated system the position of particular web defects could be tracked automatically and the re-reeler could likewise be stopped automatically at any defect which is selected for repair.

The defects to be repaired are patched in the re-reeler as shown in block 112. Thereafter the log goes to the coater represented by block 114. If the defect is acceptable under the standards set in block 110 no repair is made.

Figure 9:
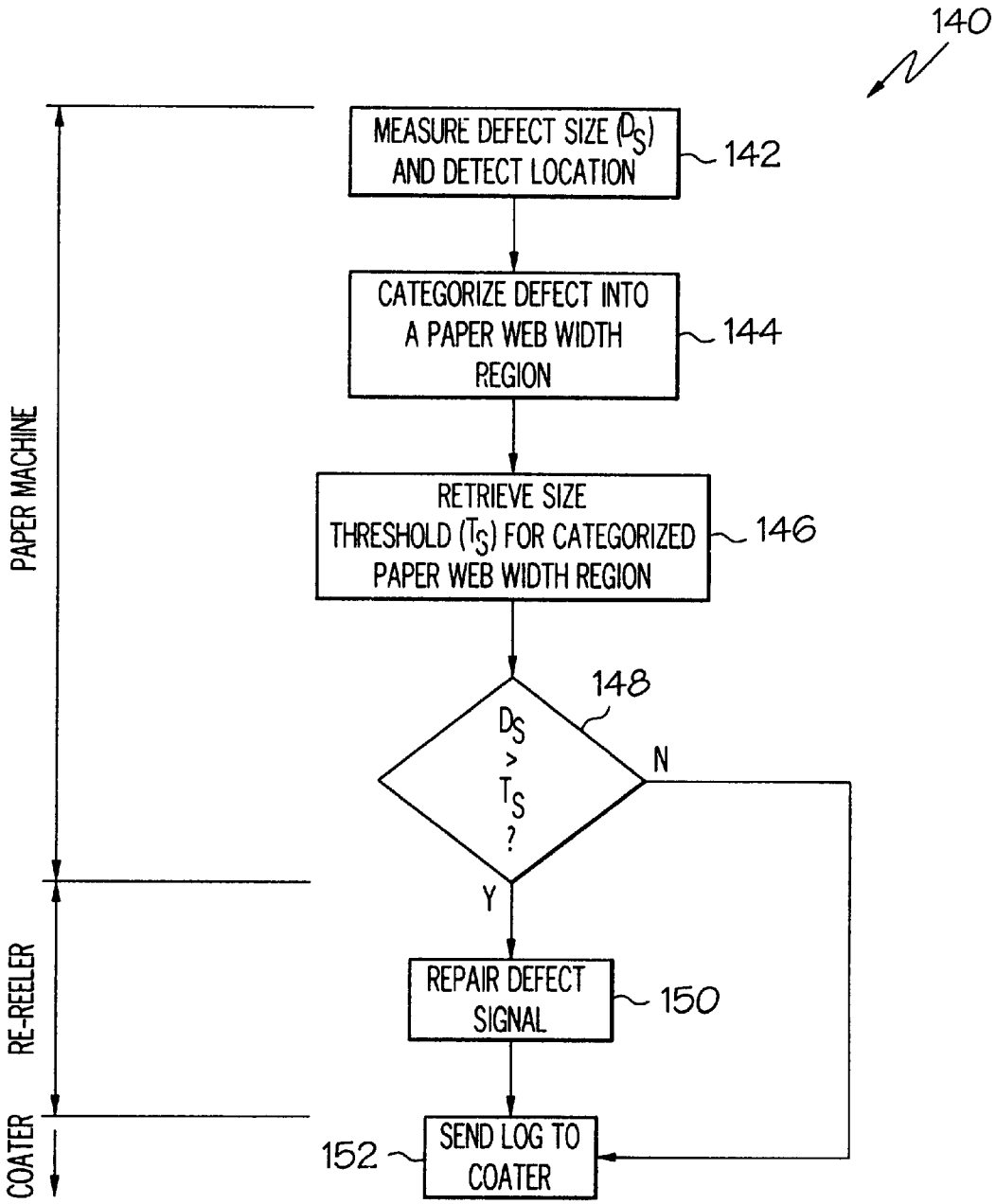
FIG. 9 is a high level flow chart of another embodiment of a method of the present invention.

Another embodiment of an operating method of the invention is discussed with reference to the flow chart 140 shown in FIG. 9. At block 142, the defect dimension and location are detected in a manner similar to that discussed above with respect to block 102 of flow chart 100. At block 144, the defect is categorized into one of a plurality of paper web width regions. In this regard, such plurality of paper web width regions may be established based upon testing results and/or calculations similar to those discussed above. For example, while a large portion of the paper web near the center may be treated as one width region, it is anticipated that the edge portions of the paper web will be treated as separate width regions due to the more significant impact which defects at such locations have upon the failure tension. This scheme results in at least three distinct paper web width regions. Based upon the test results noted above, the two paper web edge regions will preferably encompass at least the first six to twelve inches from the edge of the paper, although variations are possible. Further, defects extending from one region to another are preferably analyzed as if completely within the region having the lower defect threshold.

The through web defect being analyzed would be categorized into one of the established paper web width regions based upon the location information detected in block 142. Once categorization is made, a web defect size threshold corresponding to the categorized paper web width region is retrieved from a stored map or look-up table at block 146. The threshold size for each paper web width region may be established in a manner similar to that discussed above with respect to the threshold relative strength value. A comparison of the defect dimension and the threshold size is made at block 148, and if the defect dimension exceeds the threshold, a determination is made to consider the through web defect for correction at block 150 in a manner similar to that discussed above with respect to block 110 of flow chart 100. If the defect dimension does not exceed the threshold, then the defect is considered okay or acceptable and the log can be sent to the re-reeler without repairing the defect as indicated at block 152.

Accordingly, the present invention provides a system and method for real time monitoring of through web defects in order to facilitate selection of certain through web defects for repair. Importantly, both defect dimension and defect location relative to the side edge of the paper web are utilized in the system and method of the invention. Fracture mechanics based calculations have also been shown to be well suited for the invention.

While the forms of the apparatus herein described constitute preferred embodiments of the invention, it is to be understood that the present invention is not limited to these precise forms and that changes may be made therein without departing from the scope of the invention. For example, an optical web viewing system including optical detection devices other than CCD cameras, such as traditional video image recorders, laser detection devices, or infrared detection devices, could be used to produce defect image signals in connection with the invention. Further, while the description above focused primarily on detection and analysis through web defects, it is recognized and anticipated that the techniques of the present invention could similarly be applied to other types of web defects including light spots and dark spots. Still further, while the description above refers primarily to determining a distance from the side edge of the paper web to the CD center of the defect, it is understood that other distances, such as the distance from the side edge of the paper web to the edge of the defect could be utilized.

What is claimed is:

1. A method for monitoring web defects along a moving web of paper comprising:

(a) determining a cross machine direction dimension of a web defect as the paper web moves along an established paper path in a machine direction;

(b) determining a distance from a side edge of the paper web to a location of the web defect as the paper web moves along the established paper path;

(c) automatically establishing a value indicative of a likelihood of paper web failure at the web defect as a function of at least both the determined dimension of step (a) and the determined distance of step (b); and (d) determining whether to stop the moving paper web for repair of the web defect based at least in part upon the failure likelihood indicative value of step (c).

2. The method of claim 1 wherein:

in step (b) the distance determined is a distance from a cross machine direction center of the web defect to the side edge of the paper web in the cross machine direction; and in step (c) the failure likelihood indicative value is established utilizing a fracture mechanics based calculation scheme.

3. The method of claim 2 wherein:

step (d) includes comparing the failure likelihood indicative value of step (c) with a threshold value; and if the failure likelihood indicative value falls below the threshold value the web defect is repaired.

4. The method of claim 3 wherein the failure likelihood indicative value comprises a relative strength of the paper web in the region of the web defect.

5. The method of claim 4 wherein:

in step (c) a failure strength ($\sigma_{fracture}$) of the web at the defect location is calculated using fracture mechanics equations as follows:

$$\sigma_{fracture} = \frac{K_{ceff}}{\beta\sqrt{\pi a + \frac{K_{ceff}^2}{F_{tu}^2}}}$$

where $$\beta = 1 + \left(0.6 + 0.8\frac{E}{W}\right)\left(\sqrt{\sec\frac{\pi a}{2E}} - 1\right)$$

where $$K_{ceff} = \frac{\beta\sigma\sqrt{\pi a}}{\sqrt{1 - \frac{\beta^2\sigma^2}{aF_{tu}^2}}}$$

where E is the distance determined in step (b);

where W is the side edge to side edge width of the paper web;

where $F_{tu}$ is the tensile strength of the paper; and where a is one half the dimension determined in step (a).

6. The method of claim 5 wherein $F_{tu}$ is an estimated value.

7. The method of claim 1 wherein:

in step (b) the distance determined is a distance from a cross machine direction center of the web defect to the edge of the paper web in the cross machine direction; and in step (c) the failure likelihood indicative value is established with reference to a map which is a function of both the dimension and the distance.

8. The method of claim 1 wherein the web defect referred to in steps (a), (b), (c) and (d) comprises a through web defect.

9. A method for monitoring web defects along a moving web of paper in order to repair certain defects, comprising:

(a) optically scanning the paper web as it moves along an established paper path in a machine direction and producing defect image signals;

(b) determining a cross machine direction dimension of a web defect based upon the image signals of step (a);

(c) determining a distance from a side edge of the paper web to a location of the web defect based upon the image signals of step (a);

(d) automatically establishing a value indicative of a likelihood of paper web failure at the web defect as a function of at least both the determined dimension of step (b) and the determined distance of step (c);

(e) comparing the failure indicative value of step (d) with a threshold value; and (f) initiating a correction signal if the failure indicative value falls below the threshold value.

10. The method of claim 9 wherein the correction signal marks the web at the web defect so that the web defect can be repaired in a subsequent operation such as a re-reeler.

11. The method of claim 9 wherein the correction signal alerts an operator to the presence of the web defect.

12. The method of claim 9 comprising the further step of:

(g) monitoring a machine direction location of the web defect; and (h) stopping the paper web with the web defect at a predetermined location in a subsequent operation.

13. A system for monitoring web defects comprising:

an optical scanning device arranged to view the entire width of the paper web as the paper web moves along an established path in a machine direction, the scanning device producing defect image signals;

a controller connected to receive the defect image signals produced by the optical scanning device, the controller operable to:

determine a cross machine direction dimension of a web defect based upon the image signals received;

determine a distance from a side edge of the paper web to a location of the web defect based upon the image signals received;

establish a value indicative of a likelihood of paper web failure at the web defect as a function of at least both the determined dimension and the determined distance; and determine whether to initiate a correction signal based at least in part upon the failure likelihood indicative value.

14. The system of claim 13 wherein:

the controller is operable to determine a distance from a cross machine direction center of the web defect to the side edge of the paper web in the cross machine direction;

the controller is operable to establish the failure likelihood indicative value utilizing a fracture mechanics based calculation scheme; and the controller is operable to compare the failure likelihood indicative value with a threshold value and to produce the correction signal if the failure likelihood indicative value falls below the threshold value.

15. The system of claim 14 wherein the correction signal triggers marking of the web at the web defect.

16. The system of claim 13 wherein the optical scanning device comprises a plurality of CCD cameras.

17. A method for monitoring web defects along a moving web of paper, comprising:

(a) establishing a plurality of paper web width regions;

(b) determining a dimension of a web defect as the paper web moves along an established paper path in a machine direction;

(c) categorizing the web defect as falling into one of the established paper web width regions; and (d) determining whether to repair the web defect as a function of at least both the determined dimension of step (a) and the categorization made in step (c).

18. The method of claim 17 wherein:

step (d) includes establishing a threshold value for each of the paper web widths regions;

step (d) includes establishing a value indicative of a likelihood of paper web failure at the web defect based at least in part upon the determined dimension of step (a);

step (d) includes comparing the failure indicative value with the established threshold value corresponding to the categorization made in step (c).

19. The method of claim 18 wherein the threshold value for each paper width region is established utilizing fraction mechanics.

20. The method of claim 18 wherein the failure likelihood indicative value comprises the determined dimension of step (a) and the threshold value for each paper width region comprises a threshold defect dimension.

21. The method of claim 18 wherein in step (a) at least three paper web width regions are established and step (c) includes optically scanning the paper web.

22. The method of claim 17, wherein step (d) includes marking the paper web in the region of the web defect based upon the determined dimension of step (a) and the categorization made in step (c).

23. The method of claim 17, wherein the web defect referred to in steps (b), (c) and (d) comprises a through web defect.

24. A system for monitoring web defects comprising:

an optical scanning device arranged to view the entire width of the paper web as the paper web moves along an established path in a machine direction, the scanning device producing paper web image signals;

a controller connected to receive the paper web image signals produced by the optical scanning device, the controller operable to:

determine a dimension of a web defect based upon the image signals received;

categorize the web defect as falling into one of a plurality of established paper web width regions;

determine whether the web defect should be corrected as a function of at least both the determined dimension and the categorization made; and produce a correction signal if a determination is made that the web defect should be corrected.

25. The system of claim 24 wherein, in determining whether the web defect should be corrected, the controller is operable to:

establish a value indicative of a likelihood of paper web failure at the web defect based at least in part upon the determined dimension; and compare the failure indicative value with an established threshold value corresponding to the categorized paper width region.

26. The system of claim 24 wherein the correction signal effects a marking of the paper web in the region of the web defect for enabling identification of the location of the web defect to an operator.

27. The system of claim 24 wherein the web defect comprises a through web defect.

28. An automated method for monitoring web defects along a moving web of paper, the method comprising:

(a) scanning the paper web as it moves along an established paper path in a machine direction and producing defect indicative signals;

(b) determining a dimension of a given web defect based upon the signals of step (a);

(c) determining a cross machine direction position of the given web defect based upon the signals of step (a);

(d) automatically determining whether to identify the given web defect for possible repair as a function of at least both the dimension of step (b) and the position of step (c).

29. The method of claim 28 wherein the dimension of step (b) is a cross machine direction dimension.

30. The method of claim 29 wherein step (d) involves reference to a map stored in memory for retrieval of a stored value.

31. The method of claim 29 wherein step (d) involves calculating a value indicative of a likelihood of paper web failure at the web defect as a function of at least both the dimension of step (b) and the position of step (c).

32. A system for monitoring web defects comprising:

a scanning device arranged to view the entire width of the paper web as the paper web moves along an established path in a machine direction, the scanning device producing defect indicative signals in response to movement of defects thereby;

a controller connected to receive the defect indicative signals produced by the scanning device, the controller operable to:

determine a dimension of a given web defect based upon the defect indicative signals received from the scanning device;

determine a cross machine direction position of the given web defect based upon the defect indicative signals received;

determine whether to initiate a correction signal based at least in part upon both the determined dimension of the given web defect and the determined cross machine direction position of the given web defect.

33. The system of claim 32 wherein the determined dimension is a cross machine direction dimension of the given web defect.

34. The system of claim 32, further comprising:

a map stored in memory; and wherein the controller retrieves a stored value from the map in order to determine whether to initiate the correction signal.

* * * * *